US006843053B2

(12) United States Patent
Draper et al.

(10) Patent No.: US 6,843,053 B2
(45) Date of Patent: Jan. 18, 2005

(54) FUEL SYSTEM

(75) Inventors: David E. Draper, Bridgnorth (GB); Anthony T. Harcombe, Richmond (GB); Andrew R. Knight, Stroud (GB); David J. C. Law, London (GB); Lukhbir S. Panesar, Feltham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/427,251

(22) Filed: May 1, 2003

(65) Prior Publication Data

US 2004/0025830 A1 Feb. 12, 2004

(51) Int. Cl.[7] ..... F02M 47/02; F01N 3/20

(52) U.S. Cl. ..... 60/274; 60/285; 123/299; 123/447

(58) Field of Search ..... 123/299, 446, 123/447, 496; 60/274, 285

(56) References Cited

U.S. PATENT DOCUMENTS

| | | | | | |
|---|---|---|---|---|---|
| 3,456,629 | A | * | 7/1969 | Dangauthier | 123/299 |
| 3,759,239 | A | * | 9/1973 | Regneault et al. | 123/299 |
| 4,530,337 | A | * | 7/1985 | Laufer | 123/506 |
| 4,811,715 | A | | 3/1989 | Djordjevic et al. | |
| 5,078,113 | A | | 1/1992 | Haag et al. | |
| 5,826,425 | A | * | 10/1998 | Rossi Sebastiano et al. | 60/274 |
| 5,960,627 | A | | 10/1999 | Krampe et al. | |
| 6,267,086 | B1 | | 7/2001 | Dingle et al. | 123/25 R |
| 6,321,735 | B2 | | 11/2001 | Grieve et al. | 123/674 |
| 6,439,202 | B1 | | 8/2002 | Carroll, III et al. | 123/467 |
| 6,467,464 | B2 | | 10/2002 | Burke et al. | 123/520 |
| 6,532,941 | B2 | | 3/2003 | Begley et al. | 123/497 |
| 6,588,392 | B2 | | 7/2003 | Armstrong et al. | 123/192.1 |
| 6,622,707 | B2 | | 9/2003 | Begley et al. | 123/497 |
| 6,626,149 | B2 | * | 9/2003 | Hlousek | 123/447 |
| 6,659,086 | B2 | * | 12/2003 | Rodriguez-Amaya et al. | 123/496 |
| 6,688,278 | B2 | * | 2/2004 | Rodriguez-Amaya et al. | 123/299 |

FOREIGN PATENT DOCUMENTS

| | | | |
|---|---|---|---|
| DE | 4118236 | A1 | 12/1991 |
| DE | 4118236 | | 12/1991 |
| DE | 19636507 | A1 | 9/1995 |
| EP | 0315564 | A1 | 10/1988 |
| EP | 0381954 | A1 | 1/1990 |
| EP | 1022452 | A2 | 7/2000 |
| GB | 2310889 | A | 9/1997 |

* cited by examiner

*Primary Examiner*—Tony M. Argenbright
(74) *Attorney, Agent, or Firm*—David P. Wood

(57) ABSTRACT

A fuel system for use in an internal combustion engine comprising a fuel pump having a pumping cycle during which fuel is pressurised to a high level within a pumping chamber for delivery to an injector. The injector is arranged to provide a primary fuel injection event, and a secondary fuel injection event within the same pumping cycle. The injector includes a valve needle which is engageable with a valve needle seating to control fuel delivery and an injection control valve arrangement for controlling movement of the valve needle so as to control the primary and secondary fuel injection events. The fuel system further comprises an accumulator volume for storing high pressure fuel for delivering the secondary fuel injection quantity, and additional valve arrangement for controlling the supply of fuel stored within the accumulator volume to the injector for the secondary injection event.

23 Claims, 13 Drawing Sheets

FUEL SYSTEM

FIELD OF THE INVENTION

This invention relates to a fuel system for use in delivering fuel to a cylinder of an associated compression ignition internal combustion engine of the type provided with an after treatment device for the purpose of emission level control. The invention also relates to a method of delivering fuel to an engine.

BACKGROUND OF THE INVENTION

Known fuel systems commonly include a fuel pump having one or more cam driven plungers arranged to pressurise fuel within a pumping chamber for delivery to the injectors of the associated engine. In a unit pump/injector scheme, a single plunger is driven to pressurise fuel within a pumping chamber, from where high pressure fuel is delivered to the delivery chamber of an injector located within a housing common to the pump elements. Alternatively, the pump and the injector may communicate through a separate high pressure fuel line interconnecting the pumping chamber with an injector delivery chamber.

It is a recent development in diesel engine technology to provide the engine with an after treatment device for the purpose of improving exhaust emission levels. For regeneration purposes, such devices periodically require an injection of fuel to the engine sometime after a main injection event (referred to as "late post injection"). Typically, such late post injection of fuel may be required several times for any one tank of fuel used.

It is an object of the present invention to provide a fuel system which enables this to be achieved.

SUMMARY OF THE INVENTION AND ADVANTAGES

According to a first aspect of the invention there is provided a fuel system for use in an internal combustion engine, the fuel system comprising;

a fuel pump having a pumping cycle during which fuel is pressurised to a high level within a pumping chamber for delivery to an injector, whereby the injector is arranged to provide a primary fuel injection event, and a secondary fuel injection event within the same pumping cycle, in use, the injector including a valve needle which is engageable with a valve needle seating to control fuel delivery through an injector and injection control valve means, in the form of an injection control valve arrangement, for controlling movement of the valve needle so as to control the primary and secondary fuel injection events, the fuel system further comprising an accumulator volume for storing high pressure fuel for delivering the secondary fuel injection quantity, and additional valve means, in the form of an additional valve arrangement, for controlling the supply of fuel stored within the accumulator volume to the injector for the secondary injection event.

For the purpose of this specification, the phrase "secondary injection event" is not limited to an event which occurs later than a "primary injection event" in a pumping cycle, and the secondary injection event may equally occur before the primary injection event.

The fuel system is particularly suitable for use in an engine provided with an after treatment device for reducing emission levels. In such circumstances, the primary injection event takes the form of a main fuel injection event, during which a main fuel injection quantity is delivered, and the secondary injection event takes the form of a late post injection event, during which a late post fuel injection quantity is delivered, whereby the late post injection of fuel occurs after the main injection of fuel in the pumping cycle.

The after treatment device associated with the engine may be a nitrogen oxide absorber type device (a NOx absorber device), in which case the additional valve arrangement is preferably arranged to deliver a late post fuel injection quantity which may be approximately the same as the main fuel injection quantity.

Alternatively, if the after treatment device is of the diesel particulate filter (DPF) type, the additional valve arrangement is preferably arranged to deliver a late post fuel injection quantity which may be approximately between 5% and 20% of the main fuel injection quantity.

In one embodiment, the injection control valve arrangement and the additional valve arrangement may be arranged to provide a sequence of typically around 3 to 5 consecutive main fuel injection events, each of which is accompanied by a late post fuel injection event. Preferably, this sequence may be provided once for each tank of fuel used.

In another embodiment, the injection control valve arrangement and the additional valve arrangement may be arranged to provide a periodic distribution of late post fuel injection events between main fuel injection events. The late post fuel injection events may typically be provided between 3 and 5 times for each tank of fuel used by the engine. The number of late post fuel injection events will be selected according to the requirements of the engine/after treatment device specifications.

The additional valve arrangement may conveniently take the form of an electronically operable valve, preferably an electromagnetically operable valve. In one embodiment, the additional valve arrangement includes an electromagnetically operable actuator for switching the additional valve arrangement between open and closed states, wherein the actuator is common to the injection control valve arrangement.

In one particularly preferred embodiment, therefore, the fuel system comprises a fuel pump having a pumping cycle during which fuel is pressurised to a high level within a pumping chamber for delivery to an injector, whereby the injector is arranged to provide a main fuel injection event and a post fuel injection event, during within the same pumping cycle, the injector including a valve needle which is engageable with a valve needle seating to control said fuel delivery and an injection control valve arrangement for controlling movement of the valve needle so as to control the main and post fuel injection events, the fuel system further comprising an accumulator volume for storing high pressure fuel for delivering the post fuel injection quantity, and an additional valve arrangement which is actuable to control the supply of fuel stored within the accumulator volume to the injector for the post injection event, wherein the additional valve arrangement and the injection control valve arrangement share a common actuator.

This embodiment is advantageous as it enables specific and accurate control of the additional valve arrangement for the purpose of controlling, for example, a late post injection of fuel, and removes the need for a second, separate actuator for the injection control valve arrangement.

In an alternative embodiment, the additional valve arrangement may take the form of an hydraulically operable valve. The hydraulically operable valve may include a valve member which is movable between open and closed states in response to a fuel pressure difference across the valve member, or control surfaces of the valve member, whereby when the valve member is in the open state fuel from the accumulator volume is able to flow from the accumulator, through a return passage, into the high pressure fuel line for the purpose of administering the late post injection of fuel.

Preferably, the valve member is biased towards a closed state by means of a valve spring housed within a spring chamber. The spring chamber may communicate with a low pressure drain, the accumulator volume or the high pressure line, with the spring rate and dimensions of the valve member being selected accordingly to ensure the valve member is urged into the open state when the required pressure difference exists across the valve member or control surfaces thereof.

In another embodiment, the additional valve arrangement may also include at least a first non-return valve arranged in a primary supply passage for controlling the flow of high pressure fuel from the high pressure supply line to the accumulator volume.

In another particularly preferred embodiment, the fuel system comprises a fuel pump having a pumping cycle during which fuel is pressurised to a high level within a pumping chamber for delivery to an injector, whereby the injector is arranged to provide a main fuel injection event and a post fuel injection event, during within the same pumping cycle, the injector including a valve needle which is engageable with a valve needle seating to control said fuel delivery and an injection control valve arrangement for controlling movement of the valve needle so as to control the main and post fuel injection events, the fuel system further comprising an accumulator volume for storing high pressure fuel for delivering the post fuel injection quantity, and an hydraulically operable valve arrangement, (i.e. a valve operable under hydraulic forces and not having a separate actuation means), for controlling the supply of fuel stored within the accumulator volume to the injector for the post injection event.

Conveniently, the fuel system may include a drive arrangement for the pumping plunger. Preferably, the drive arrangement takes the form of a cam drive arrangement including a cam having a surface with one or more cam lobes. Preferably, the cam drive arrangement includes a roller and a drive member, whereby the roller co-operates with the cam surface to impart movement to the drive member, thereby to drive the pumping plunger to perform a pumping stroke during which the plunger moves to reduce the volume of the pumping chamber.

The invention is not limited to use in administering a late post injection of fuel for the purpose of regenerating an after treatment device associated with the engine, but equally may be used to provide a pilot injection of fuel just before or just after a main fuel injection of fuel, or may be used to shape the injection rate characteristics.

For example, the injection control valve arrangement and the additional valve arrangement may be arranged to provide the primary injection event at a primary fuel injection rate, and the secondary injection event at a secondary fuel injection rate which is greater than the primary fuel injection rate (i.e. a so-called "boot-shaped" injection).

According to a second aspect of the invention there is provided a method of delivering fuel to an internal combustion engine provided with an after treatment device for reducing emission levels, the method comprising;

driving a pumping plunger to perform a pumping stroke of a pumping cycle, thereby to pressurise fuel within the pumping chamber to a high level, following which the pumping plunger performs a return stroke of the pumping cycle, delivering high pressure fuel to an injector associated with the engine through a high pressure line, controlling an injection control valve arrangement to move between an open state to commence a main fuel injection event and a closed state to terminate the main fuel injection event, during which main fuel injection event a main fuel injection quantity is delivered to the engine, and moving the injection control valve arrangement from the closed state to the open state to permit a late post fuel injection quantity to be delivered to the engine, within the pumping cycle and a period of time after the main fuel injection event, for the purpose of regeneration of the after treatment device.

In one embodiment, the method is achieved by appropriate shaping of the cam surface to ensure that the main fuel injection event is terminated prior to completion of the pumping stroke (i.e. just prior to full plunger lift), just before the plunger rides over the peak of the cam lobe. Thus, the cam may be shaped such that there is a sufficient period at the end of the pumping stroke (just prior to full plunger lift) to charge the high pressure volume of the pumping chamber (and any interconnecting high pressure fuel passage(s)) with sufficient fuel as is required for the late post fuel injection event. This aspect of the invention avoids the need for the additional valve means and the accumulator volume (and possibly a non-return valve in the high pressure line), and instead relies on trapped fuel within the high pressure line and interconnecting passages being delivered for the late post injection event.

The late post injection event may be administered after the completion of the pumping stroke, either just after full plunger lift during a "top dwell" period between the pumping stroke and the return stroke, just after the plunger commences the return stroke or some time after the plunger commences the return stroke (up to an engine position of, for example, 90 degrees after top-dead-centre).

Preferably, the step of providing the late post fuel injection quantity may be performed for up to 5% of main fuel injections.

In one embodiment, the method includes the step of providing a sequence of around 3 to 5 consecutive main fuel injection events, each of which is accompanied by a late post fuel injection event.

More preferably, said sequence is provided once for each tank of fuel used by the engine.

In another embodiment, the method may include the step of providing a periodic distribution of late post injection events between main fuel injection events.

Preferably, the late post injection events are provided several times for each tank of fuel used by the engine.

It will be appreciated that preferred and/or optional features of the first aspect of the invention are equally applicable to the second aspect of the invention.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
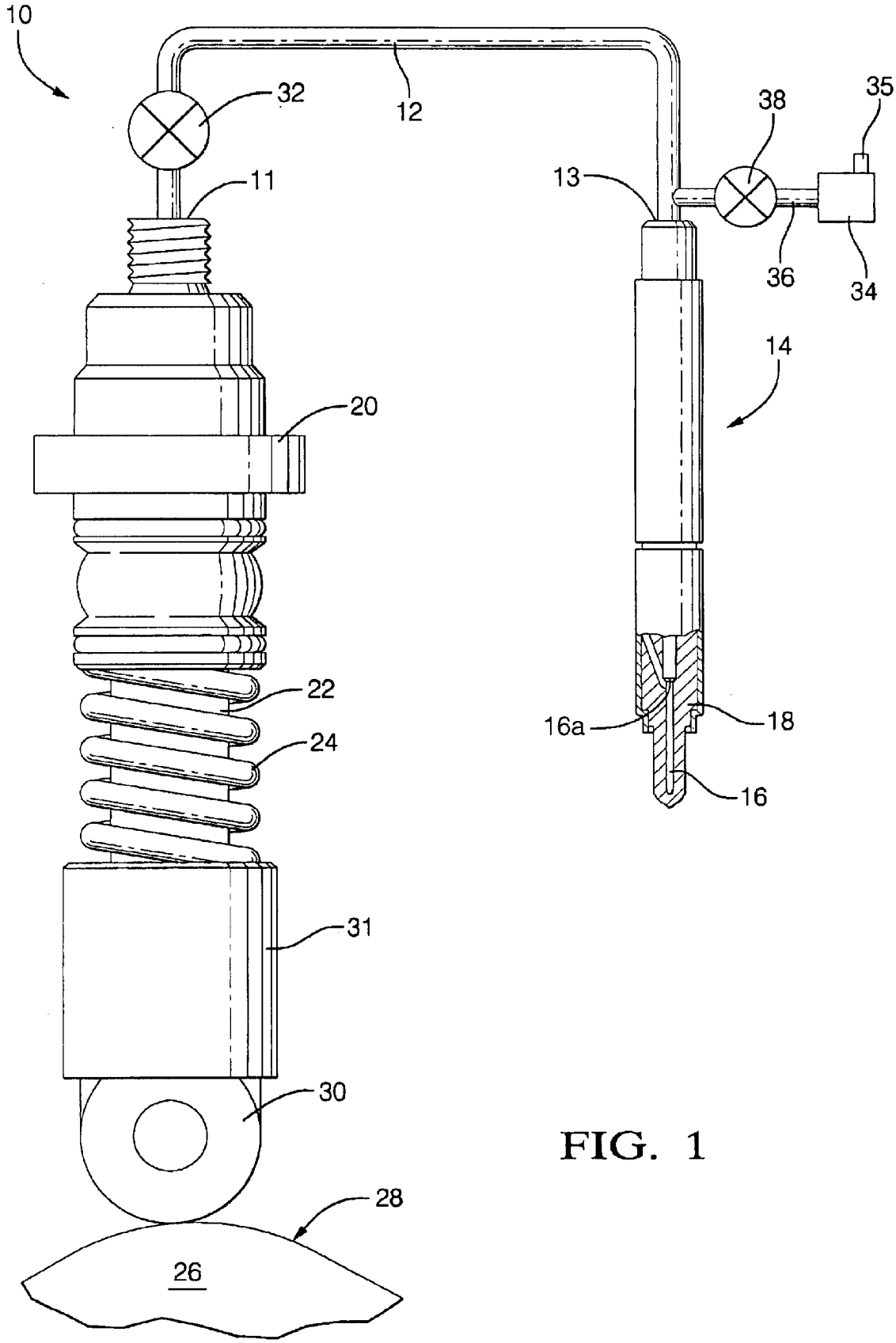
FIG. 1 is a schematic diagram to illustrate a fuel system in accordance with a first aspect of the invention.

The fuel system illustrated in FIG. 1 is suitable for use in fuelling an engine provided with an after treatment device for the purpose of regulating emission levels. Such devices may be of the NOx absorber type, or may be of the diesel particulate filter (DPF) type, both of which are known in the art. For the purpose of regenerating such devices, it is necessary to inject a quantity of fuel into the engine some time after a main fuel injection event, commonly referred to as "late post fuel injection". Such late post fuel injection is typically required for up to 5% of main injection events.

The fuel system includes a unit fuel pump 10, the outlet 11 of which communicates through a high pressure fuel line 12 with an inlet 13 of an electronically controlled fuel injector 14. The pump 10 and the injector 14 are both controlled electronically by a control unit (not shown) which receives signals from a plurality of sensors monitoring, for example, engine speed, position and temperature. The signals supplied to the control unit by the sensors are used in controlling the operation of the fuel system to appropriately control the pressure of fuel supplied to the injector 14 and the timing at which injection of fuel to a cylinder of the associated engine takes place, as described in further detail below.

The fuel injector comprises a valve needle 16 which is slideable within a bore formed in a nozzle body 18. The needle 16 includes angled thrust surfaces 16*a* orientated such that the application of fuel under high pressure from the high pressure fuel line 12 applies a force to the valve needle 16 urging the valve needle 18 out of engagement with a valve needle seating to permit fuel injection into the engine.

The injector is preferably of the type in which fuel is supplied to a control chamber (not shown) from the high pressure fuel line 12, through an injector supply passage (not shown). The control chamber communicates continuously with the injector supply passage through a restriction. Fuel pressure within the control chamber is controlled by injection control valve means, or an injection control valve arrangement, typically in the form of an electromagnetically operable injection control valve, which is arranged to control communication between the control chamber and a low pressure drain. By controlling the injection control valve to move between open and closed states, valve needle movement towards and away from the valve needle seating is controlled to provide the required fuel injection characteristics.

The unit pump 10 is of a known type, including a pump housing 20 defining a bore (not shown) within which a pumping plunger 22 is reciprocable under the action of a cam drive arrangement mounted upon an engine driven shaft. The plunger 22 is arranged to act against a return spring 24. The plunger bore defines, together with an end surface of the plunger, a pumping chamber (not shown) which communicates with the high pressure fuel line 12 through a non-return delivery valve 32 in a known manner. The non-return valve 32 is urged into an open position in which the pump outlet 11 communicates with the injector inlet 13, when fuel pressure within the pumping chamber is increased beyond a predetermined amount.

The cam drive arrangement includes a cam 26 having a cam surface 28 with one or more cam lobes, the cam surface 28 co-operating with a roller 30 of the cam drive arrangement to cause reciprocating movement of the plunger 22 within its bore through a drive member 31, typically in the form of a tappet or a shoe. In use, as the roller 30 rides over the surface of the cam 26, the plunger 22 performs a pumping cycle including a pumping stroke during which the plunger is driven inwardly within its bore to reduce the volume of the pumping chamber, and a return stroke during which the plunger is urged outwardly from its bore under the action of the return spring 24 to increase the volume of the pumping chamber. When the plunger adopts its innermost position within its bore, and the volume of the pumping chamber is at a minimum, the plunger is said to be at "full plunger lift".

For some cam profiles, the plunger may also experience what is commonly referred to as "top dwell", where the plunger remains, or "dwells", on the lobe of the cam surface for a period of time following the pumping stroke but before the return stroke commences.

Downstream of the non-return valve 32, the high pressure line 12 communicates with a reservoir or accumulator volume 34 for high pressure fuel through a flow path 36 provided with an additional valve means, or additional valve arrangement, in the form of a late post injection control valve 38. The late post injection control valve 38 is preferably provided with an electromagnetic actuator for switching the valve between an open state, in which the high pressure line 12 communicates with the accumulator volume 34, and a closed state in which communication between the line 12 and the volume 34 is broken. If desired, a pressure transducer 35 may be provided for measuring the pressure of fuel within the accumulator volume 34, and an output signal from the pressure transducer 35 may be fed back to the control unit for the purpose of controlling valve operation.

Unit fuel pumps 10 of the type shown in FIG. 1 are generally known, and are operable to control the timing of commencement of fuel pressurisation within the pumping chamber under the control of a pressure control valve (not shown). The description of such a fuel pump may be found in the Applicants published European patent application EP 0957261 A2.

Figure 2:
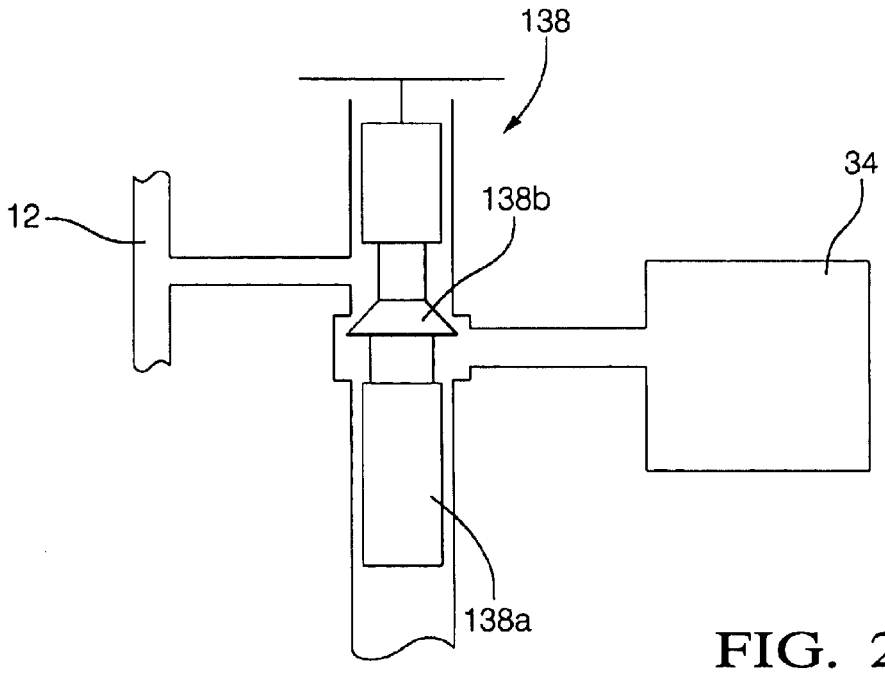
FIGS. 2 to 5 show alternative designs for a hydraulically operable late post injection control valve for use in the system of FIG. 1.

By way of example, FIG. 2 shows an electromagnetically actuable valve 138 which may be used to control the flow of fuel between the accumulator volume 34 and the high pressure fuel line 12. The late post injection control valve 138 includes a pressure balanced on-off valve member 138*a* which is movable between an open state, in which an enlarged portion 138*b* thereof is moved away from a valve seating to permit communication between the accumulator 34 and the high pressure fuel line 12, and a closed state in which the enlarged portion 138*b* is seated to close communication. The control valve 138 includes an associated electromagnetic actuator (not shown) which is energisable to switch the valve member 138*a* between its open and closed positions in response to signals received from the control unit, which signals are generated in response to the output from the pressure transducer 35.

As an alternative, or in addition, the control signals for the control valve 138 may be generated in response to other engine fuelling requirements.

As the drive shaft rotates in use, the cam drive arrangement permits outward movement of the plunger under the action of the return spring 24 (the return stroke), during which fuel at relatively low pressure is drawn from a fuel reservoir through the open pressure control valve to the pumping chamber. Initially, the injection control valve of the injector 14 is de-energised and is in its closed state to ensure fuel pressure within the control chamber is sufficiently high to seat the valve needle 16, thus ensuring injection does not take place.

The movement of the cam drive arrangement results, subsequently, in the plunger reaching its outermost position and commencing inward movement (the pumping stroke), during which the volume of the pumping chamber is reduced. Whilst the pressure control valve of the pump remains de-energized, inward movement of the pumping plunger simply displaces fuel back to the low pressure drain reservoir, and thus does not result in pressurization of the high pressure fuel line 12. When it is determined that pressurization of the fuel line 12 should commence, a signal is applied by the control unit to the pressure control valve to cause it to close, thereby breaking communication between pumping chamber and the low pressure drain. Continued inward movement of the pumping plunger as the roller 30 rides over the cam surface 28 therefore results in pressurization of the fuel within the pumping chamber, and a point will be reached at which the delivery valve of the pump is caused to open to permit fuel flow into the high pressure fuel line 12.

As a result of the pressurization of the fuel within the high pressure fuel line 12, the fuel pressure applied to the injector 14 increases, but as the injection control valve of the injector 14 is closed, the force due to fuel pressure within the control chamber and that applied to the thrust surfaces 16*a* of the valve needle 16 are substantially equal thus ensuring that the valve needle 16 remains in engagement with its seating.

Initially during the pumping stroke, the late post injection control valve 38 in the flow passage 36 is in its open state to permit pressurised fuel in the line 12 to flow into the accumulator volume 34. When fuel pressure within the accumulator volume 34 reaches the required level for late post injection, as measured by the pressure transducer 35, the late post injection control valve 38 is closed by switching the electromagnetic actuator to terminate flow into the volume 34, as described further below Alternatively, the late post injection control valve may be closed in response to a prediction in compression based on the amount of plunger movement and system volume.

When it is required to commence a primary (main) injection of fuel, for which a main fuel injection quantity is injected into the engine, the electromagnetic actuator of the injection control valve is energised causing the injection control valve to open. Fuel is therefore able to flow from the control chamber to the low pressure drain such that fuel pressure within the control chamber falls, thereby reducing the magnitude of the force urging the valve needle towards its seating and permitting the valve needle 16 to lift under the action of the fuel acting upon the thrust surfaces 16*a*. Such movement of the valve needle 16 permits fuel to flow past the seating to one or more injector outlets, and through the outlet(s) to be injected to the engine cylinder.

When the desired quantity of fuel has been delivered to the engine during the main injection event, the injection control valve is closed to increase fuel pressure within the control chamber. The magnitude of the force urging the valve needle 16 towards its seating is therefore increased, until a point is reached beyond which the valve needle 16 returns into engagement with its seating, thus terminating the supply of fuel to the engine cylinder. It will be apparent from the description hereinbefore that the operation of the injection control valve of the injector controls the timing at which fuel injection takes place.

For the purpose of regenerating the after treatment device associated with the engine, it is necessary to provide a secondary injection of fuel late in the pumping cycle, as described previously. Preferably, this is required when engine position is between 20° and 180° after the main injection event, and more preferably when it is around 30° after the main injection event. The desired injection timing range and the peak injection pressure are determined by appropriate shaping of the cam profile, but this can present a problem in known fuel systems as the cam profile shape limits the fuelling period. The requirement for a late post injection of fuel after the main injection cannot therefore be accommodated in known schemes.

The present invention overcomes this, however, by providing the accumulator volume 34 and the additional late post injection control valve 38. The cam surface 28 is shaped such that, at the end of the main injection event when the injection control valve is moved to its closed state to re-seat the valve needle 16, the plunger is only part way through its pumping stroke, and so pressurisation of fuel within the pumping chamber continues after the main fuel injection event has terminated. High pressure fuel thus continues to flow into the high pressure line 12, and hence into the accumulator volume 34, until such time as the late post injection control valve 38 is closed to trap high pressure fuel within the volume 34. Switching of the late post injection control valve 38 into its closed state is controlled by means of the electromagnetic actuator under the control of the control unit, which generates control signals for the actuator in response to the output from the pressure transducer 35, for example, to indicate that fuel pressure within the accumulator volume 34 has reached the required level.

When it is desired to inject the late post fuel injection quantity, the late post injection control valve 38 is actuated to its open state, therefore permitting a further flow of high pressure fuel to the high pressure line 12 and, hence, to the injector 14. At substantially the same time the injection control valve is energised once more to cause the valve needle 16 to lift, thereby to permit the late post injection of fuel into the engine. The injector 14 is typically operated in accordance with a so-called "pressure-time" delivery regime whereby, for a given delivery pressure, the valve needle 16 is held open for an appropriate period of time to give the required late post injection delivery quantity.

Inward movement of the pumping plunger continues until the plunger reaches its innermost position within its bore and the volume of the pumping chamber is at a minimum, after which the plunger may dwell and then commence outward movement under the action of the spring 24 acting in combination with any residual fuel pressure within the pumping chamber. The late post injection of fuel may preferably be provided when the plunger is close to, or just after, full plunger lift. This includes, for example, providing the late post injection of fuel when the plunger is performing its return stroke. When it is desired to terminate the late post injection of fuel, both the late post injection control valve 38 and the injection control valve are moved to their closed positions.

It will be appreciated that, as the plunger commences its return stroke and fuel pressure within the pumping chamber is reduced, the non-return valve 32 is caused to close under the force of high pressure fuel in the line 12. Thus, flow of high pressure fuel from the accumulator volume 34, back through the line 12 to the pump is prevented, even if the late post injection control valve 38 is opened.

The fuel system in FIG. 1 may be operated in an alternative way, by controlling the late post injection control valve 38 such that the accumulator volume 34 is filled gradually over a series of pumping cycles, rather than by filling the volume 34 completely during one cycle before the main injection takes place.

Figure 4:
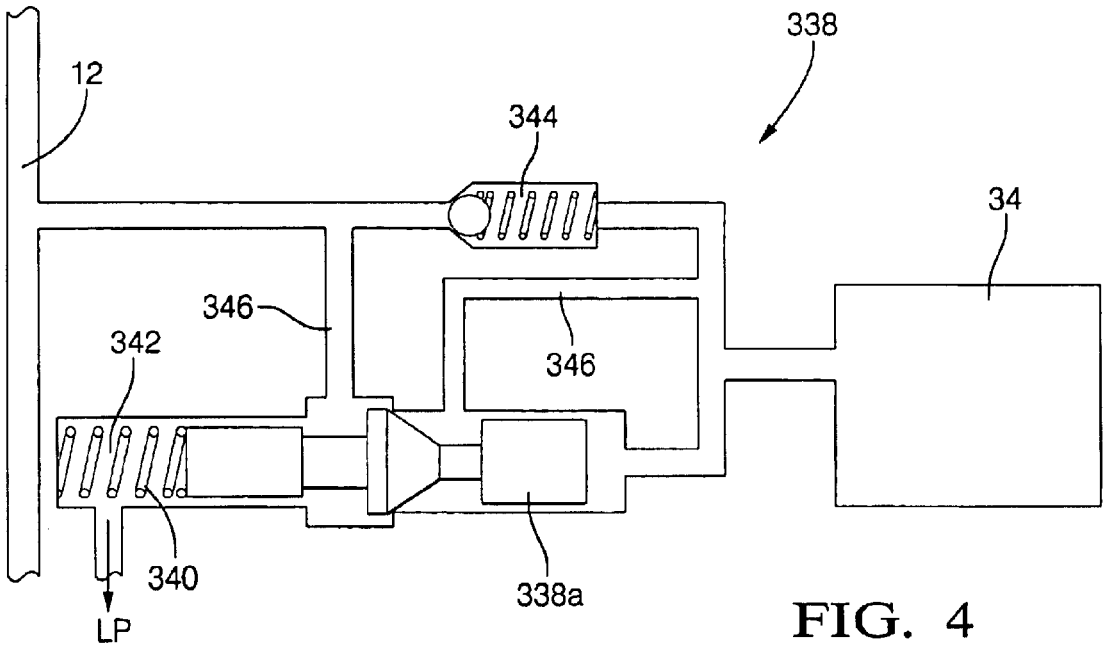
Figure 5:
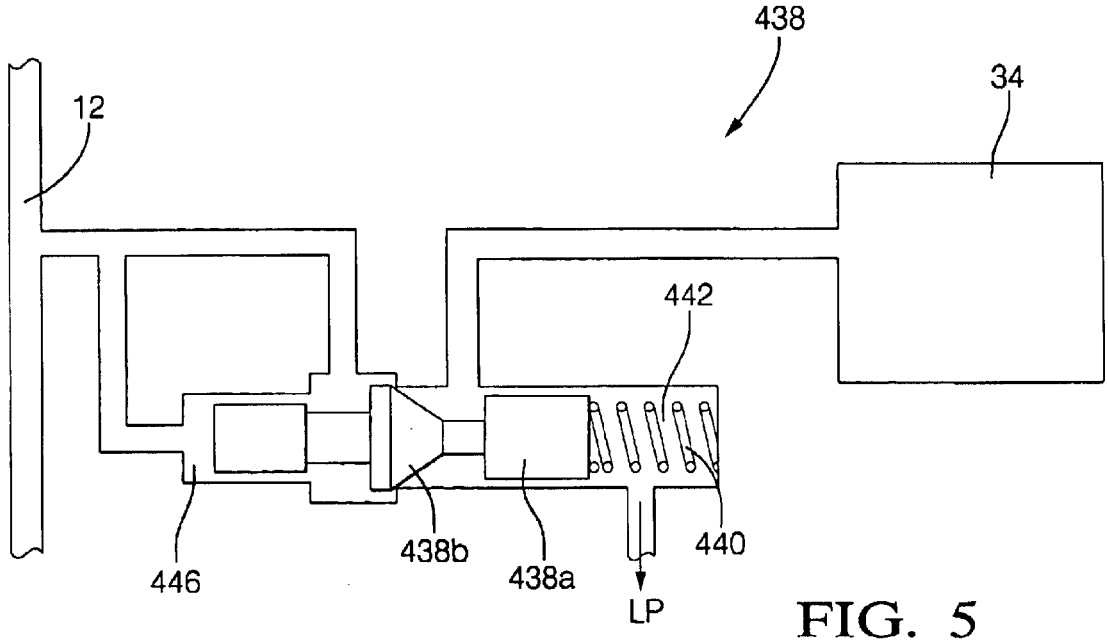

As an alternative scheme to that shown in FIG. 2, the late post injection control valve 38 need not be provided with an actuator, but may be hydraulically operable in dependence upon fuel pressure within the accumulator volume 34 and the passage 36 (and hence the high pressure line 12). Examples of alternative hydraulically operable late post injection control valves 38 are shown in FIGS. 3 to 5.

Figure 3:
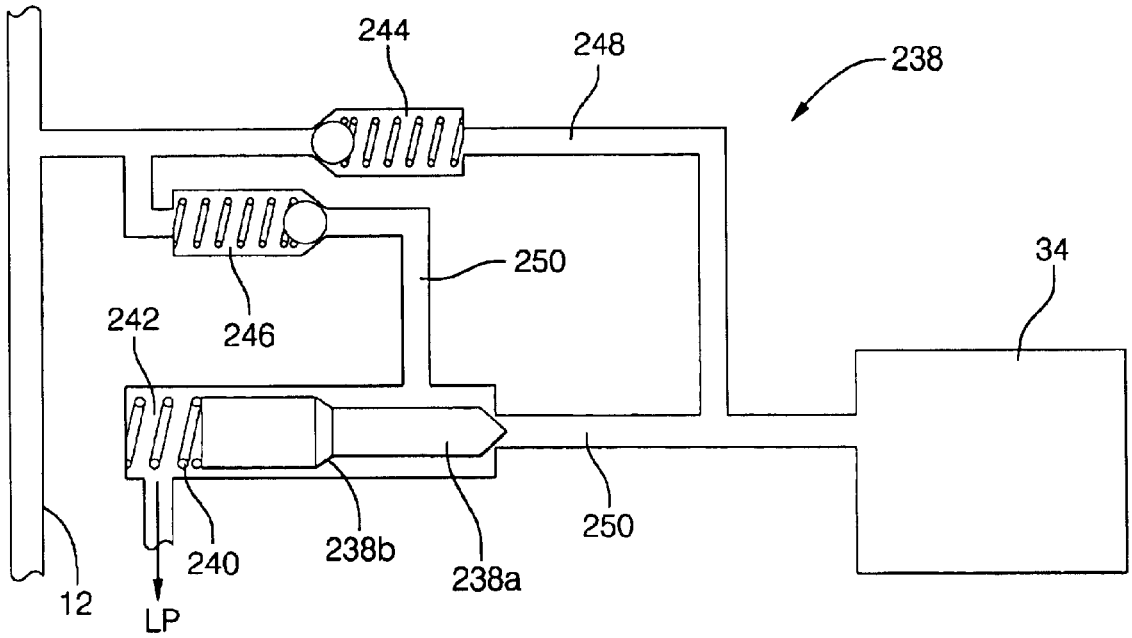

The late post injection control valve 238 of FIG. 3 includes a valve member 238*a* which is biased closed by means of a valve spring 240 housed within a spring chamber 242 connected to low pressure. The control valve 238 also includes first and second non-return valves 244, 246 arranged in primary and return flow passages 248, 250 respectively. The valve member 238*a* is hydraulically operable between open and closed states in response to the fuel pressure difference across the valve member 238*a* i.e. between fuel pressure within the accumulator volume 34 and fuel pressure within the spring chamber 242. When fuel pressure within the accumulator volume 34 is relatively low, the first non-return valve 244 is forced open due to high pressure fuel within the line 12 and the accumulator 34 is thus filled with high pressure fuel. As fuel pressure within the accumulator 34, and hence within the primary flow passage 248, increases, a point will be reached at which the pressure difference across the valve member 238*a* exceeds a predetermined amount, governed by the biasing force of the spring 240 and low pressure fuel within the chamber 242. At this point the valve member 238*a* is urged open and high pressure fuel is able to flow through the return flow passage 250, urging the second non-return valve 246 open and permitting high pressure fuel from the accumulator 34 to flow into the line 12, ready for the late post injection of fuel.

It will be appreciated that other control surfaces of the valve member 238*a*, for example the angled surface 238*b*) will also experience a force due to fuel pressure, and that the phase "fuel pressure difference across the valve member" is intended to mean the difference between fuel pressure acting to move the valve member in a first direction and fuel pressure acting to move the valve member in a second, opposite direction.

As an alternative to FIG. 3 (not shown), the non-return valves 244, 246 and the passage 250 may be omitted so that only a single valve member 238*a* controls communication between the accumulator 34 and the high pressure line 12 which, again, is movable in response to the fuel pressure difference across it. In a further alternative embodiment, the non-return valve 246 is omitted but the passage 250 is included.

As a further alternative to FIG. 3 (also not shown), the chamber 242 housing the spring 240 may communicate with the high pressure line 12, instead of low pressure, with the spring rate and the dimensions of the valve member 238*a* are adjusted accordingly.

FIG. 4 shows an alternative hydraulically operable valve 338 including a pressure balanced switching valve member 338*a*. The valve member 338*a* is movable between open and closed states in response to the fuel pressure difference across the valve member 338*a*. A non-return valve 344 is provided to control the flow into the accumulator volume 34 from the high pressure line 12. When the non-return valve 344 is urged closed due to increased pressure within the accumulator volume 34, and the valve member 338*a* is urged open, a return flow of fuel is permitted through a return flow passage 346, past the open valve member 338*a*, and back to the high pressure line 12, ready for the next late post injection event.

As in FIG. 3, the chamber 342 for the spring 340 is shown in communication with low pressure, but alternatively the spring rate and the valve 348*a* may be dimensioned such that the spring chamber communicates with the high pressure line 12 instead.

FIG. 5 is a still further alternative design for an hydraulically operable control valve 438, in which no non-return valves are provided. The valve 438 includes a valve member 438*a* having an enlarged, seatable portion 438*b*, which is movable in response to the difference in fuel pressure across the valve 438*a*. A first end of the valve member 438*a* experiences a force due to a spring 440 in a spring chamber 442 (along with a force due to low fuel pressure in the chamber 442) and the opposite end of the valve member 438*a* experiences a force due to high pressure fuel in the chamber 446. When the force due to fuel pressure within the chamber 446 (i.e. within the high pressure line 12) is sufficient to overcome the force acting on the first end of the valve member 438*a* (acting in combination with fuel pressure acting on the enlarged portion 438*b*), the valve is urged closed to prevent flow between the line 12 and the volume 34.

Again, in FIG. 5 the chamber 442 is shown as being in communication with low pressure, but alternatively it may communicate with the accumulator volume 34, the spring force and the valve member 438*a* dimensions being selected accordingly to cause the valve 438 to open when the required pressure is achieved in the accumulator volume 34.

In a further alternative scheme (not shown) to that described with reference to FIGS. 1 to 5, the late post injection valve 38 and the injection control valve need not be provided with separate actuators, but may be configured to share a common actuator which is operable under the control of the control unit to control the respective timing of main and late post injection. Such schemes suitable for implementing control of two valves using only one actuator are described in U.S. Pat. No. 5,893,350 and EP 0913573A2.

In practice, it may only be necessary to provide the injector associated with one cylinder of the engine with the late post injection control valve 38 and the accumulator volume 34 for the purpose of administering the late post injection of fuel.

The fuel system is not limited to use in administering a late post injection of fuel for the purpose of regenerating an after treatment device associated with the engine, but instead may be used to provide a pilot injection of fuel just before or just after a main fuel injection of fuel. For example, the invention may be used to provide a close-coupled post injection, shortly after the main injection of fuel.

Alternatively, the invention may be used to shape the injection characteristic of a main injection event, for example by providing a primary fuel injection event at a primary fuel injection rate, and a secondary fuel injection event at a secondary fuel injection rate. If the secondary fuel injection event is greater than the primary fuel injection rate, the injection event has a so-called "boot-shaped" injection characteristic. In this embodiment, the primary and secondary injection events are sequential (i.e. back to back) and effectively form a single injection event having a first stage low injection rate and a second stage higher injection rate.

Figure 6:
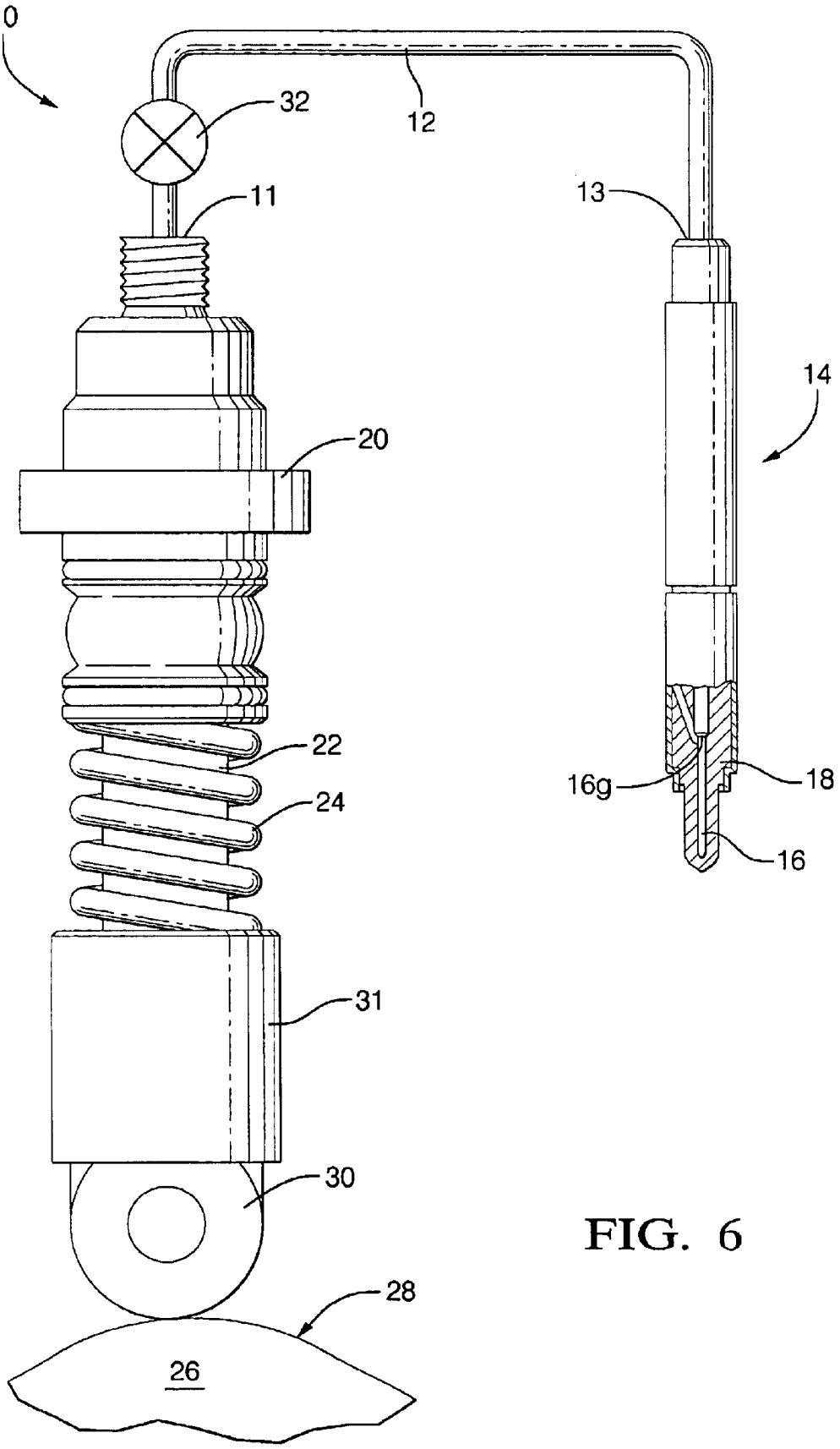
FIG. 6 is a schematic diagram to illustrate an alternative fuelling method in accordance with a second aspect of the invention.

Referring to FIG. 6, in a further alternative embodiment the late post injection control valve 38 and the accumulator volume 34 may be deleted. Instead, the injection control valve alone is operable to provide both the main injection of fuel and the late post injection of fuel. This is achieved by shaping the cam profile to ensure the plunger performs the remainder of its pumping stroke after the main injection event is terminated. Once the main injection event has been terminated by closing the injection control valve, fuel pressurisation within the pumping chamber continues until the end of the pumping stroke. During the remainder of the pumping stroke, the injection control valve is re-opened to commence the late post injection of fuel and is closed when the desired quantity of fuel has been injected.

Alternatively, the injection control valve may be re-opened after full plunger lift to provide the late post injection of fuel, providing that enough pressurised fuel remains trapped in the high pressure line 12 after the main injection to provide the required late post injection delivery quantity. For example, the cam surface 28 may be shaped such that the plunger remains at "top-dwell" for a period of time between the end of the pumping stroke and the start of the return stroke, and the late post injection may be administered during this period. Alternatively, the late post injection may be administered at the start of the return stroke, or well into the return stroke when the plunger is some way down the trailing edge of the cam lobe.

The embodiment of the invention described with reference to FIG. 6 is particularly suitable for applications where the required late post injection fuel quantity is relatively small, for example around 10% of the main fuel injection quantity. Such late post injection fuelling amounts are particularly suitable for use with DPF type after treatment devices.

For applications where a relatively large late post injection fuel quantity is required, for example volumes approaching the main fuel injection quantity, it may be more appropriate to use the embodiments shown in FIGS. 1 to 5. In particular, this embodiment is suitable for use in engines provided with an NOx absorber type device.

It will be appreciated that the fuel system in accordance with the invention may include a fuel pump in which the quantity of fuel supplied to the pumping chamber is metered to permit control of the fuel injection pressure, rather than by means of a pressure control (spill) valve.

As an alternative to any of the embodiments shown in FIGS. 1 to 5, the non return valve 32 may be removed due to the provision of the additional valve 38.

Figure 7:
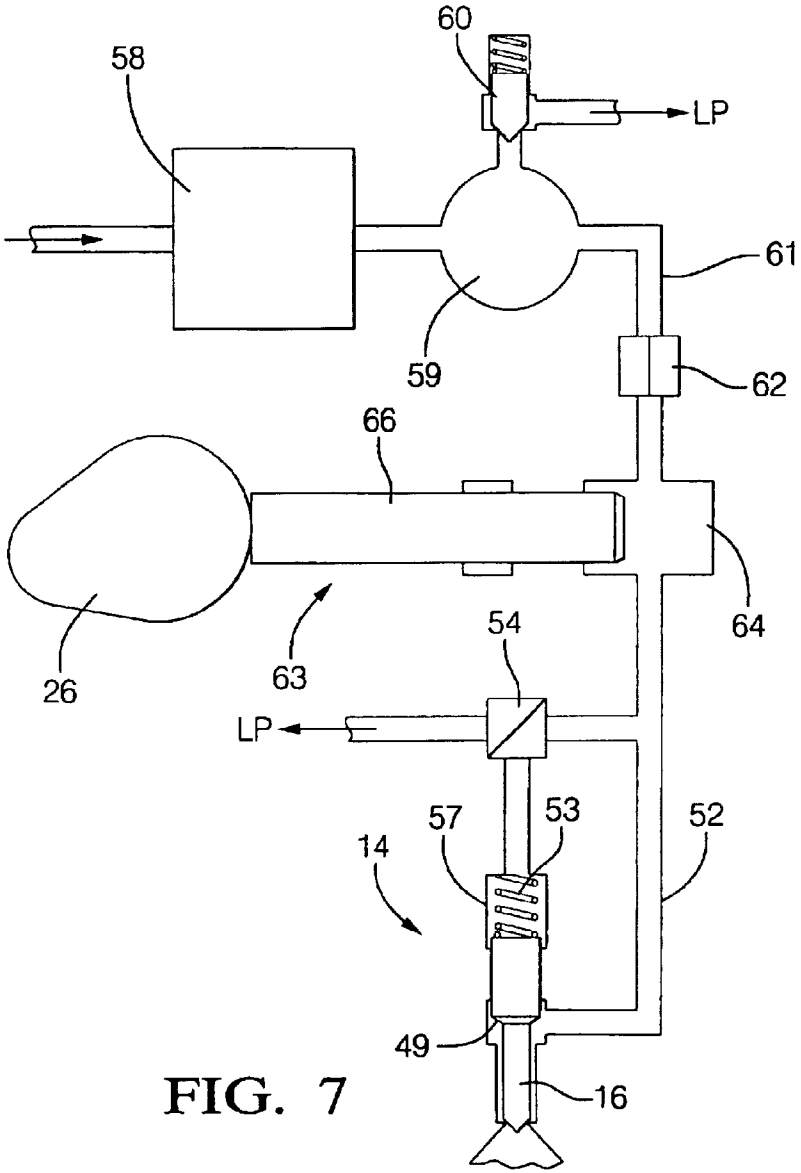
FIG. 7 is a schematic diagram of a further embodiment of a fuel injection system in which the system is in a first operating state.

An alternative fuel injection system of the present invention is shown in FIG. 7. The fuel injection system includes an injector 14 including an injection nozzle having a valve needle 16, the back end of which (the uppermost end in the illustration shown) is exposed to fuel pressure within a control chamber 57. An associated high pressure supply passage or line 52 delivers fuel to an injector delivery chamber 49. The injector 14 has an associated control valve, in the form of a nozzle or needle control valve 54. The nozzle control valve 54 is operable between a first position (herein referred to as a "closed" position) and a second position (herein referred to as an "open" position). When in the "closed" position, communication between the injector control chamber 57 and a low pressure reservoir is "closed" and the injector control chamber 57 communicates with the high pressure supply line 52. When in the "open" position, communication between the control chamber 57 and the low pressure reservoir is "open" and communication between the high pressure supply line 52 and the control chamber 57 is broken. A spring 53 is located in the control chamber 57 and serves to urge the valve needle towards a seated position in which it is engaged with a valve needle seating and no injection occurs.

It will be appreciated that it need not be a surface of the valve needle itself that is exposed to fuel pressure within the control chamber 57, but a surface associated with the valve needle, for example an extension of the valve needle, may be exposed to fuel pressure within the control chamber 57. Additionally, the chamber 57, and hence the valve needle spring 53, may be located remotely from the valve needle itself, whilst still providing the required closing force to seat the valve needle to termination of injection. A further design option is to locate the spring 53 elsewhere, and not within the control chamber 57. Further alternative variations in injector design will be apparent to those familiar with this technical field.

The fuel injection system also includes a common rail fuel pump 58 for supplying fuel at a moderately high and injectable pressure level (e.g. 300 bar) to an accumulator volume in the form of a common rail 59. It will be understood by the skilled reader that the phrase "common rail" is not limited to an accumulator volume of any particular shape or structure and may, for example, be of linear, spherical or other suitable configuration for storing high pressure fuel. A pressure regulator 60 is provided to maintain the pressure of fuel within the common rail 59 at a substantially constant level. For clarity, only one fuel injector 14 is shown in the system of FIG. 7, although in practice a plurality of injectors would be supplied with fuel from the common rail 59 in a multi-cylinder engine.

The common rail 59 supplies pressurised fuel to a supply passage or rail pressure line 61, in communication with a pump chamber 64, under the control of an electrically operable valve arrangement in the form of a rail control valve 62. The rail control valve 62 provides a similar function to the additional valves 38, 138, 238, 338, 438 in FIGS. 1 to 5 respectively, as will be apparent from the following description.

The pump chamber 64 forms part of pump means or a pump arrangement 63 including a pumping plunger 66 (equivalent to pumping plunger 22 in FIGS. 1 and 6), that is driven by means of a cam drive arrangement including a driven cam 26. Each injector 14 of the system has a dedicated pumping arrangement 63, and thus has a dedicated pumping plunger 66 and cam 26. Conveniently, the injector 14 and its dedicated plunger 66 may be arranged within a common unit, in a so-called unit pump or unit injector arrangement, such as that shown in FIGS. 1 and 6. Typically, the cams 26 of each pump arrangement 63 are mounted upon a common shaft that is driven by the engine drive shaft. As the plunger 66 is driven, in use, it performs a pumping stroke, in which the plunger 66 is moved in a direction to reduce the volume of its associated pump chamber 64, and a return stroke, in which the plunger is moved in a direction to increase the volume of the pump chamber 64. The plunger 66 is typically provided with a plunger return spring (not illustrated in FIG. 7, but as shown as item 24 in FIGS. 1 and 6) to effect the plunger return stroke.

The electrically operable rail control valve 62 is actuated in response to an electronic control signal provided by an associated engine controller to move the valve 62 between open and closed positions, and in this way the pressure of fuel that is supplied to the high pressure supply line 52 can be controlled. In FIG. 7, the fuel injection system is in a first operating state, in which the rail control valve 62 adopts its open position in which the common rail 59 communicates with the pump chamber 64. Under such circumstances, reciprocating movement of the plunger 66 has substantially no effect on fuel pressure within the chamber 64. Thus, with the rail control valve 62 in the open position, the pressure of fuel supplied through the high pressure supply line 52 to the injector 14 is determined by the pressure of fuel within the common rail 59, which, typically, will be around 300 bar. The nozzle control valve 54 is in a closed state, in which communication between the control chamber 57 and the low pressure reservoir is closed and the control chamber 57 communicates with the high pressure supply line 52. Thus there is a high force acting on the back end of the valve needle 16 due to high pressure fuel within the control chamber 57, and this force aids the force due to the spring 53 in ensuring the valve needle 16 is seated to prevent fuel injection.

Figure 8:
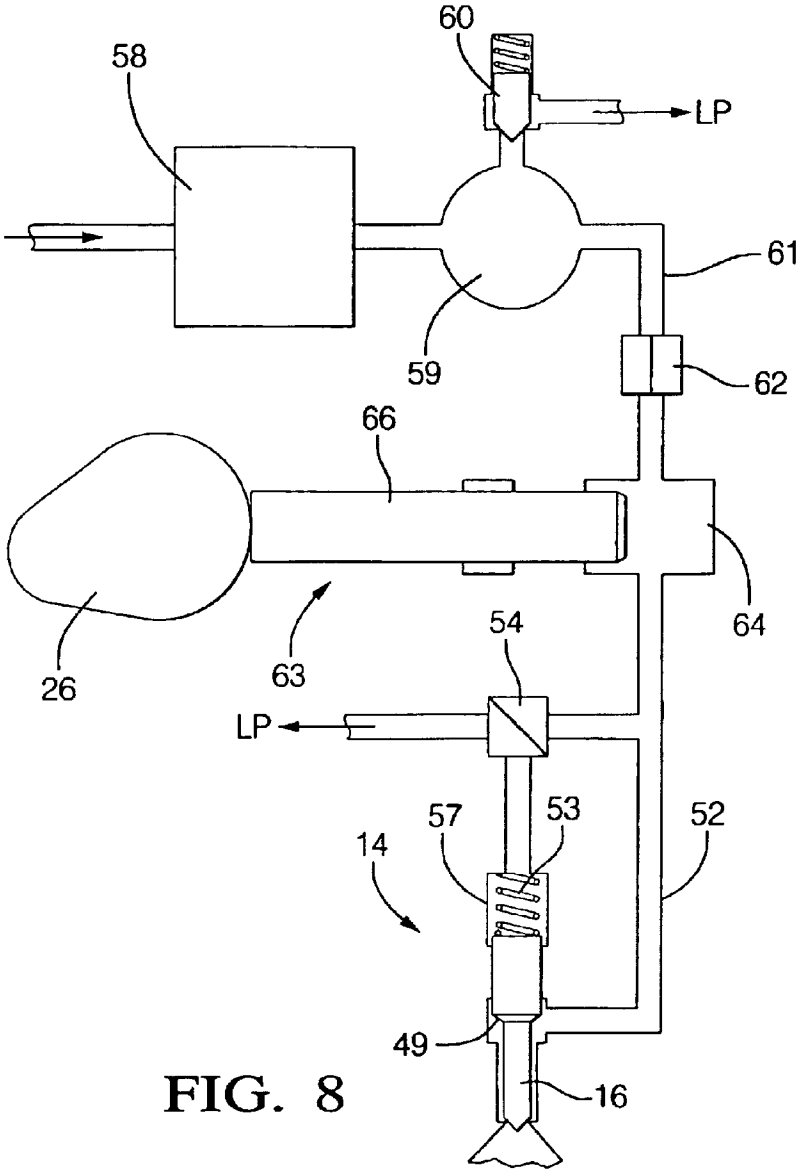
FIG. 8 shows the fuel injection system in FIG. 7 when in a second operating state.

Referring to FIG. 8, in order to inject fuel at a first, moderate pressure level (P1), determined by the pressure of fuel within the rail 59, the nozzle control valve 54 is actuated to move into an open position in which communication between the control chamber 57 and the low pressure reservoir is opened, thereby causing fuel pressure within the control chamber 57 to be reduced. The valve needle is caused to lift away from its seating due to a force acting on one or more valve needle thrust surfaces by high pressure fuel delivered to the injector 14. During this first injecting state, fuel is injected into the engine at a first pressure level (P1) that is referred to as a "moderate" pressure level but is nonetheless sufficiently high to be an injectable pressure level for combustion.

Figure 9:
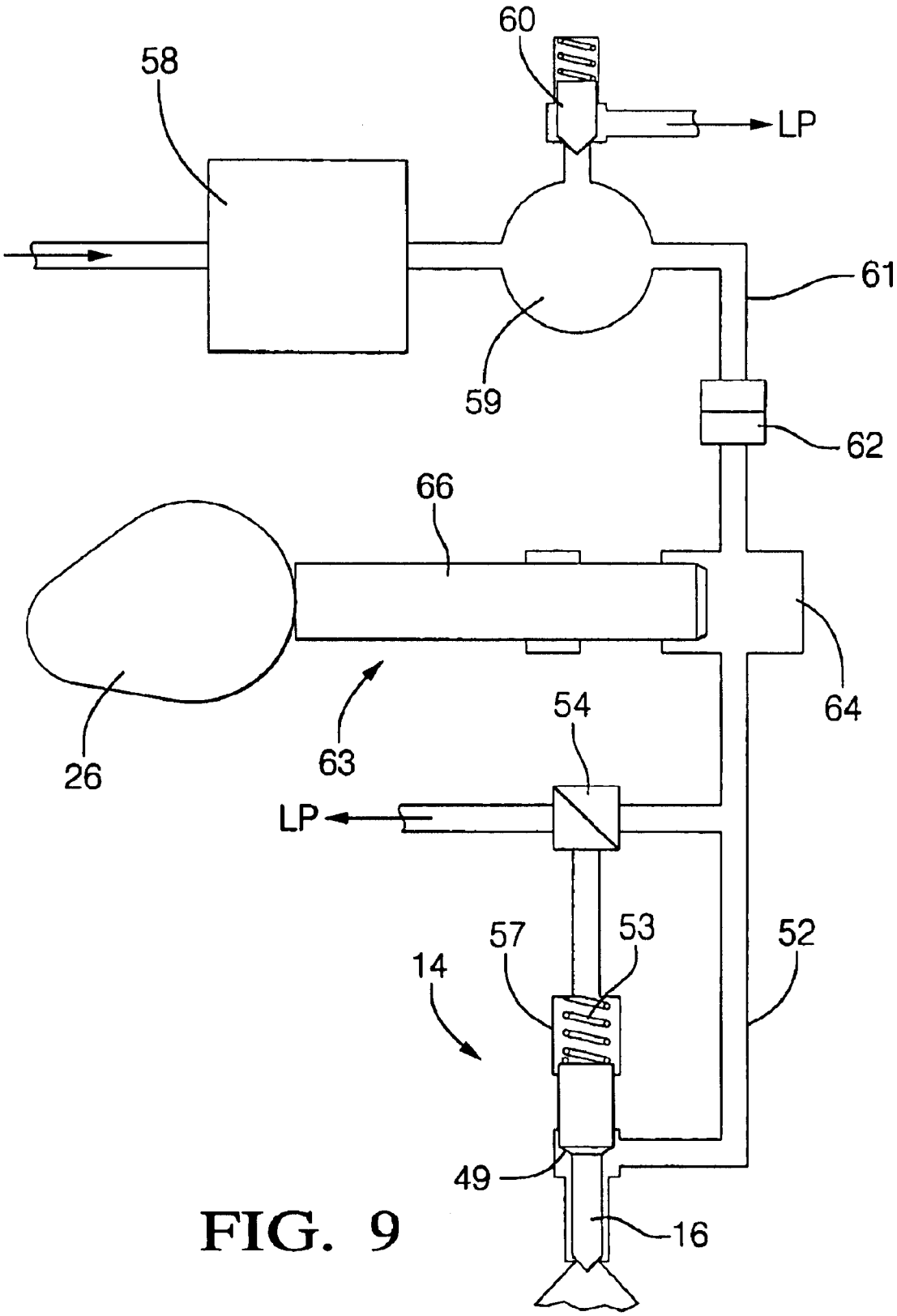
FIG. 9 shows the fuel injection system in FIGS. 7 and 8 when in a third operating state.

FIG. 9 shows the fuel injection system in FIGS. 7 and 8 when in a second operating state in which the rail control valve 62 has been moved into its closed position to break communication between the rail pressure line 61 from the common rail 59 and the pump chamber 64. With the rail control valve 62 in its closed position, reciprocal movement of the plunger 66 under the influence of the cam 26 enables fuel pressure within the pump chamber 64 to be increased to a second injectable pressure level (P2), which is greater than the first pressure level (P1). Typically, the second pressure level is between 2000 and 2500 bar. With the rail control valve 62 closed and with fuel pressure in the pump chamber 64 at the second injectable pressure level, the nozzle control valve 54 can then be actuated to move into its open position in which the injector control chamber 57 is brought into communication with the low pressure reservoir. By moving the nozzle control valve 54 into its open position, the valve needle is caused to lift from its seating, as described previously, to permit injection at this second, higher pressure level, P2.

The timing of injection of fuel at the first, moderate pressure level, P1, is therefore controlled by operation of the nozzle control valve 54 while the rail control valve 62 is open and the timing of injection of fuel at the second, higher pressure level is controlled by operation of the nozzle control valve 54 while the rail control valve 62 is closed, and in which circumstances the pump arrangement 63 serves to increase the pressure of fuel supplied by the common rail 59 to the second higher pressure level, P2. For both the first and second operating pressures, P1, P2, the timing at which injection is terminated is controlled by moving the nozzle control valve 54 to its closed position so as to close communication between the control chamber 57 and the low pressure reservoir, thereby re-establishing high fuel pressure in the injector control chamber 57 and causing the valve needle to seat.

In an alternative mode of operation, injection at the second, higher pressure level can be terminated by moving the nozzle control valve 54 into its open position and, at about the same time, opening the rail control valve 62. By opening the rail control valve 62 at the same time as the nozzle control valve 54 is opened, closure of the valve needle is aided due to communication between the pump chamber 64 and the common rail 59 causing a reduction in pressure within the high pressure supply line 52 and the injector 14 (i.e. pressure is reduced to the first pressure level, P1).

From the foregoing description it will be appreciated that the system of FIGS. 7 to 9 has two distinct modes of operation, one in which the system operates in a common rail-type mode in which fuel at the first, moderate rail pressure is delivered to the injector 14 and one in which the system operates in an EUI-type mode in which fuel at a second, higher level is delivered to the injector 14. By varying the operating mode between the first and second, it will be appreciated that a range of different injection characteristics can be achieved. Typically, for example the main injection of fuel in an injection cycle may be provided by operating in EUI-type mode (higher pressure level), and non-main injections of fuel, such as pilot or post injections of fuel or injections for after-treatment purposes, may be provided by operating in common rail-type mode (moderate pressure level).

It is a particular advantage of the fuel injection system in FIGS. 7 to 9 that an injection event comprising a pilot injection of fuel at a first, moderate pressure level followed by a main injection event at a second, higher pressure level can be achieved. It has been found that this combination of a pilot followed by a main injection of fuel provides a benefit for emissions levels and noise.

To illustrate the injection characteristic of the fuel injection system in FIGS. 7 to 9, FIG. 10 shows an example of the injection rate R of fuel as a function of time T, for an injection event including a pilot injection of fuel followed by a main injection of fuel. It will be appreciated that the injection rate for any given injection nozzle will depend upon the actual pressure of fuel that is supplied to the nozzle.

Figure 10:
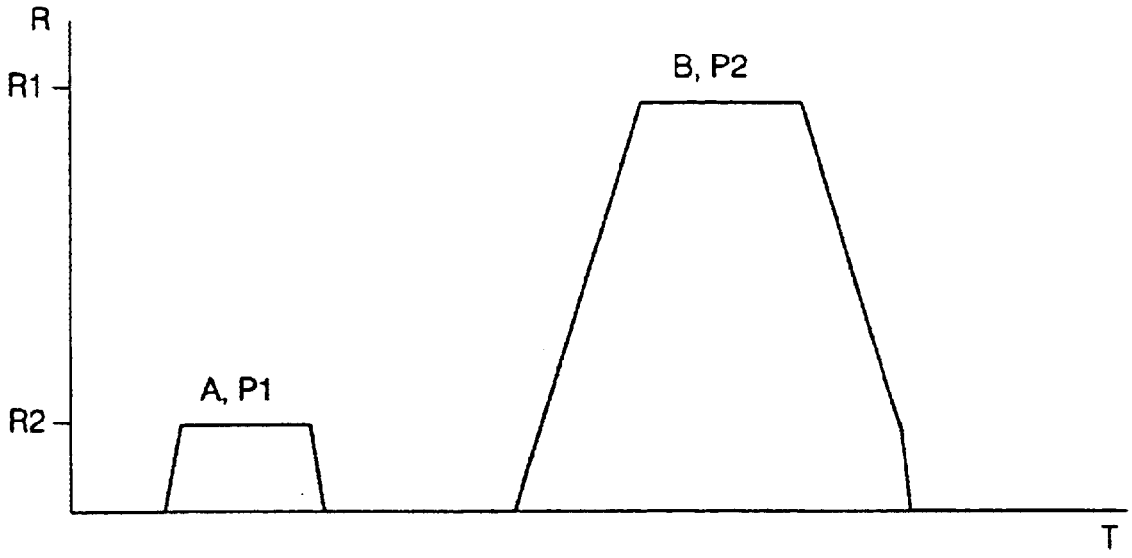
FIG. 10 is a graph showing a fuel injection characteristic that is obtainable using the fuel injection system in FIGS. 7 to 9.

Referring to FIG. 10, the initial pilot injection of fuel, A, at a rate R1 is achieved by injecting fuel at moderate rail pressure, P1, for a relatively short duration of time. A main injection of fuel, B, follows at a higher rate R2 and at pressure level P2. For the pilot injection of fuel, the injection rate R1 is achieved by moving the rail control valve 62 into its open position and maintaining the rail control valve 62 in this position whilst the nozzle control valve 54 is moved into its open position to cause the injector valve needle 16 to lift. The pilot injection of fuel is terminated by closing the nozzle control valve 54 to re-establish high pressure fuel within the control chamber 57, thereby causing the valve needle 16 to seat.

Injection at the second, higher pressure level, P2, is generated by closing the rail control valve 62 such that the pump arrangement 63 causes fuel pressure within the pump chamber 64 to be increased to a level higher than that within the common rail 59. The nozzle control valve 54 is opened to commence the main injection of fuel, B, at this second pressure level, P2 and is closed to terminate the main injection, as described previously.

As mentioned previously, the rail control valve 62 can also be closed at about the same time as the nozzle control valve 54 is opened to aid a rapid termination of injection at the second pressure level, P2.

Figure 11:
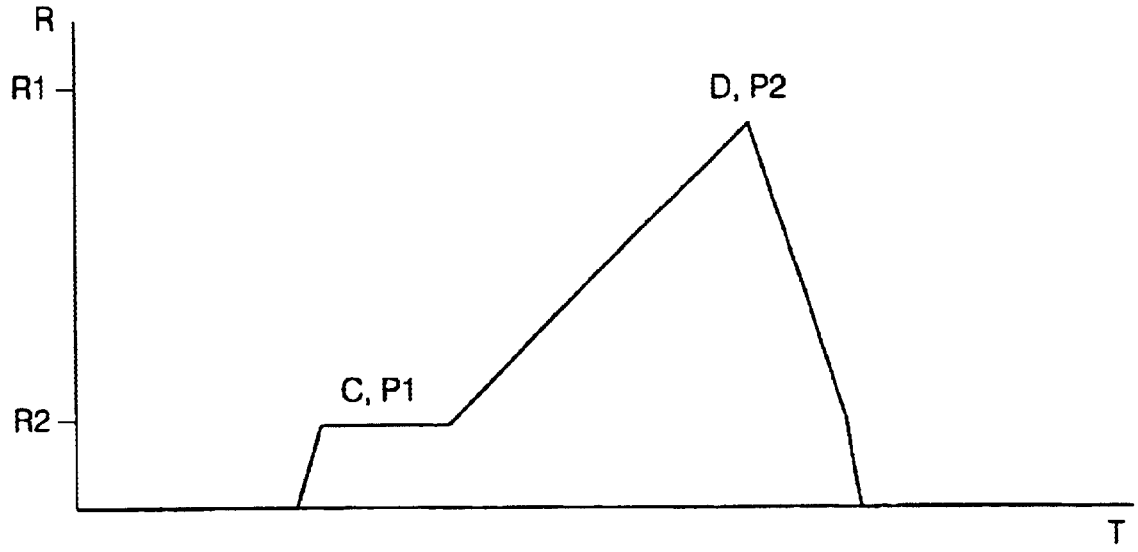
FIG. 11 is another graph showing an alternative fuel injection characteristic which is obtainable using the fuel injection system of FIGS. 7 to 9.

It has also been found that a main injection of fuel having a so-called "bootshaped" injection characteristic, as shown in FIG. 11, provides particular benefits for emissions levels. A boot-shaped main injection includes an initial injection of fuel, C, at a first rate R1 (rail pressure P1) followed immediately by an injection of fuel at a higher rate, R2 (pump chamber pressure, P2) and is achieved by moving the rail control valve 62 between its open position (rail pressure P1) and its closed position (increased pressure P2) whilst the nozzle control valve 54 is held in its open position so as to maintain the valve needle in its lifted position.

It will be appreciated that the pressure levels P1, P2 and the injection rates R1, R2 are arbitrary, and need not represent the same pressure levels and injection rates in both FIG. 10 and FIG. 11.

Figure 12:
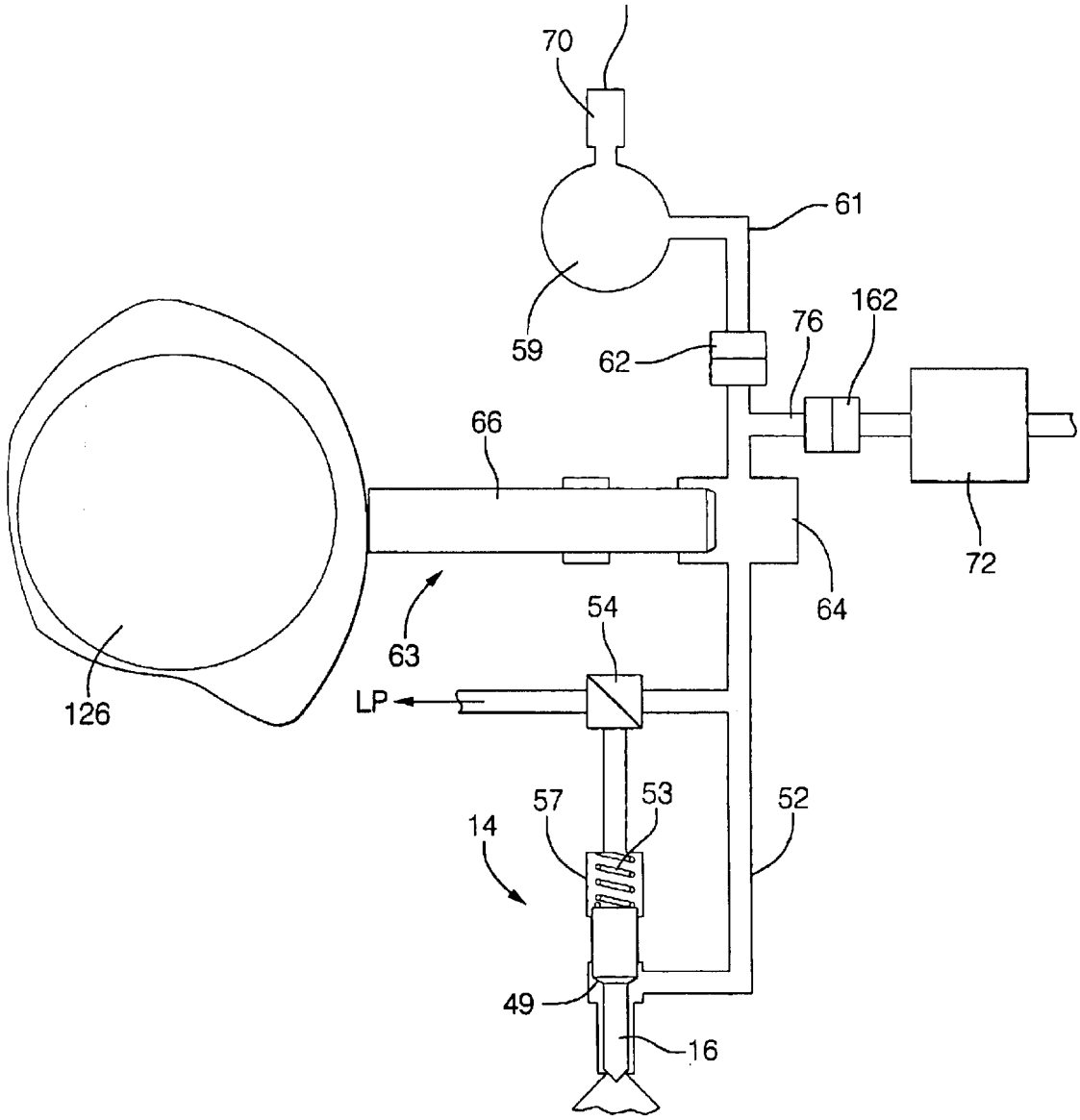
FIG. 12 is schematic diagram to illustrate an alternative embodiment of the fuel injection system to that shown in FIGS. 7 to 9.

In a variation to the fuel injection shown in FIGS. 7 to 9, the common rail fuel pump 54 for supplying fuel to the common rail 59 may be removed, and instead the pump arrangement 63 itself may be used to charge the common rail 59 to a first, injectable pressure level. FIG. 12 is an alternative embodiment in which no common rail fuel pump is provided. Similar components to those shown in FIGS. 7 to 9 are identified with like reference numerals and will not be described in further detail.

Referring to FIG. 12, the common rail 59 is provided with a rail pressure sensor 70 for monitoring the pressure of fuel within the rail 59 and for providing an output signal that is a measure of fuel pressure within the rail 59. A low pressure pump 72 is provided for supplying fuel to the pump chamber 64 under the control of an electrically actuable control valve 162, or "fill/spill" valve, that is operable between open and closed positions. When the fill/spill valve 162 is in the open position the low pressure pump 72 supplies fuel to the pump chamber 64 at a relatively low pressure, P3, through a supply passage 76. When the fill/spill valve 162 is in a closed position the supply of fuel to the pump chamber 64 by the pump 72 is prevented. Typically, the low pressure pump 72 may take the form of a transfer pump that is arranged to supply fuel at a pressure level dependent upon engine speed (referred to as "transfer pressure").

In use, the fill/spill valve 162 is moved into its open state during the plunger return stroke so that fuel is supplied from the transfer pump 72 to the pumping chamber 64 through the supply passage 76. As the plunger 66 is driven by the cam during the pumping stroke, the fill/spill valve 162 is closed and the pressure of fuel within the pump chamber 64 is increased to a level that is higher than transfer pressure, but typically less than the pressure that would be achieved by a high pressure common rail-type pump. If during this time the rail control valve 62 is held in its open position, fuel at the first injectable pressure level is supplied to the common rail 59. Fuel at this first injectable pressure level is also supplied to the high pressure supply line 52. Typically, the pressure of fuel within the pumping chamber 64 during this operating state is at a moderate pressure level of between 300 and 1000 bar.

If, with the fill/spill valve 162 closed, the rail control valve 62 is also closed, the pressure of fuel within the pumping chamber 64 will be increased during the pumping stroke of the plunger 66 to a second pressure level that is higher than the first. Typically, this second injectable pressure level may be between 2000 and 3000 bar.

During both the first and second modes of operation, commencement of injection is controlled by actuating the nozzle control valve 54 to move into its open position so that fuel in the control chamber 57 is able to flow to low pressure, so allowing the valve needle 16 to open. Injection may be terminated by actuating the nozzle control valve 54 to move into its closed position so that high fuel pressure is re-established within the control chamber 57.

Again, it can therefore be considered that the fuel injection system of FIG. 12 has two distinct modes of operation. In a first mode of operation, the system operates in a common rail-type mode in which plunger movement has minimal or no effect on the pressure level in the pumping chamber 64 due to the rail control valve 62 being open, and fuel at the first, moderate rail pressure (P1) is delivered to the injector 14. In a second mode of operation the system operates in an EUI-type mode in which plunger movement increases the pressure level to a second higher level (P2), due to the rail control valve 62 being closed, and fuel at this higher level is delivered to the injector 14.

It will be appreciated that the relative timing of operation of the rail control valve 62 and of the fill/spill valve 162 is important, so as to ensure that fuel is pressurised within the pump chamber 64 during the pumping stroke and is not simply returned to the transfer pump 72 through an "open" fill/spill valve and also to ensure that pressurisation to the second pressure level occurs at the required time (i.e. by closing the rail control valve 62). In practice, for example, the time for which the valves 162, 62 are open, and the relative timing of their opening and closure, will be controlled by control signals provided by the engine controller in accordance with look-up tables or data maps containing pre-stored information. The implementation of look-up tables and data maps for engine fuelling purposes would be familiar to a person skilled in this technical field.

An alternative to operating the nozzle control valve 54 to terminate injection, with the system of FIG. 12 it is possible to terminate injection by relieving high fuel pressure within the supply line 52 through operation of the fill/spill valve 162. Termination of injection in this manner may be referred to as "spill-type" end of injection, or "spill-end" of injection. If during the pumping stroke of the plunger 66, and with the valve needle 16 lifted so that injection is occurring, the fill/spill valve 162 is moved into its open position, fuel within the pumping chamber 64 is caused to flow back through the passage 76 to the transfer pump 72 so that the pressure of fuel in the supply line 52 to the injector 14 is reduced. In such circumstances, the opening force on the valve needle due to fuel pressure delivered through the high pressure supply line 52 to the delivery chamber 49 is reduced which, in combination with the force due to the spring 53, will cause the valve needle to be seated to terminate injection. Termination of injection can therefore be achieved, even if the nozzle control valve 54 remains in its open position. It has been found that terminating injection in this way may benefit the fuel spray formation, and thus may benefit emissions levels, as there is no requirement to force the valve needle 16 to close against the high hydraulic force acting in the opening direction due to pressurised fuel in the supply line 52.

As a further alternative method of terminating injection, the nozzle control valve 54 may be actuated at or about the same time as the fill/spill valve 162 is opened, so that reduced fuel pressure within the high pressure supply line 52 by virtue of the open fill/spill valve 162 is complemented by the opening of communication between the control chamber 57 at the back of the valve needle 16 and the low pressure reservoir. Termination of injection in this way is therefore a combination of spill-end injection and nozzle control valve actuation.

It is a further feature of the fuel injection system in FIG. 12 that if it is desirable to reduce the pressure of fuel that is stored within the common rail 59, this can be achieved by actuating the rail control valve 62 to open when the fill/spill valve 162 is open, thereby permitting pressurised fuel within the rail 59 to flow to the transfer pump 72. The output signal 70 provided by the pressure sensor 70 is supplied to the engine controller, which in turn supplies the control signals to the rail control valve 62 and the fill/spill valve 162 so as to cause them to open when it is required to relieve fuel pressure within the rail.

Another difference between the embodiment shown in FIGS. 7 to 9 and that in FIG. 12 is that in the latter case the pumping plunger 66 is driven by a cam arrangement having a cam 126 with an "irregular" cam surface. The cam 126 is shaped such that the return stroke of the plunger 66 is "interrupted" and therefore includes a number of discrete steps of plunger movement. Each of the cams 126 of the system is shaped in a similar manner, and the cams that are mounted upon a common cam shaft are oriented relative to one another so that each step of plunger movement through the return stroke of one plunger is substantially synchronous with a pumping stroke of one of the other plungers of the system.

Typically, each cam surface is shaped to include a rising flank, and the remainder of the cam surface includes a surface irregularity which serves to define an interval of interruption in the return stroke of the associated plunger between or separating adjacent steps of return stroke movement. In one preferred configuration, each cam surface is shaped to define a number of steps of movement through the associated return stroke that is equal to the number of other plungers for which the associated cams share a common drive shift. Alternatively, however, the number of steps in the return stroke may be one less than the number of other plungers in the pump.

A more detailed description of a cam arrangement of this type is given in our published British patent application, GB0229487.2, the full contents of which are incorporated herein by reference. One benefit of using a cam arrangement in which the cams are shaped and configured to provide phased, stepped return stroke movement is that reversal of torque loading on the cam shaft (i.e. the variation between positive and negative torque loading) is reduced. The peak torque loading on the cam shaft is also reduced. Furthermore, as the total hydraulic volume of the pumping chambers 64 of the system is maintained at a reasonably constant level at all stages of operation, fluctuations of the high pressure level within this total volume are limited and, hence, the total volume can be made smaller.

As an alternative to providing each plunger with a cam that is shaped to provide stepped return stroke movement, a cam having two or more lobes may be used to drive each plunger. Using a twin-lobed cam, for example, one cam lobe may be used to provide a first pumping stroke of the plunger 66 for pressurising fuel within the pump chamber 64 to the second injectable pressure level P2 during the EUI-type mode of operation (rail control valve 62 closed), and the second lobe of the cam may be used to provide a second pumping stroke of the plunger 66 for pressurising fuel within the pump chamber 64 to the first injectable pressure level, P1, during the common rail-type mode of operation of the system (rail control valve 62 open). For a part of the first pumping stroke of the plunger effected by the first cam lobe, pressurisation to the second pressure level P2 occurs by closing the rail control valve 62 and pressurisation to the first pressure level to supplement rail pressure is also possible for the first pumping stroke by opening the rail control valve 62 part way through the stroke. It will be appreciated that the part of the first pumping stroke that is used to supplement pressurisation to the first pressure level occurs outside the period for which injection at the second pressure level occurs.

Figure 13:
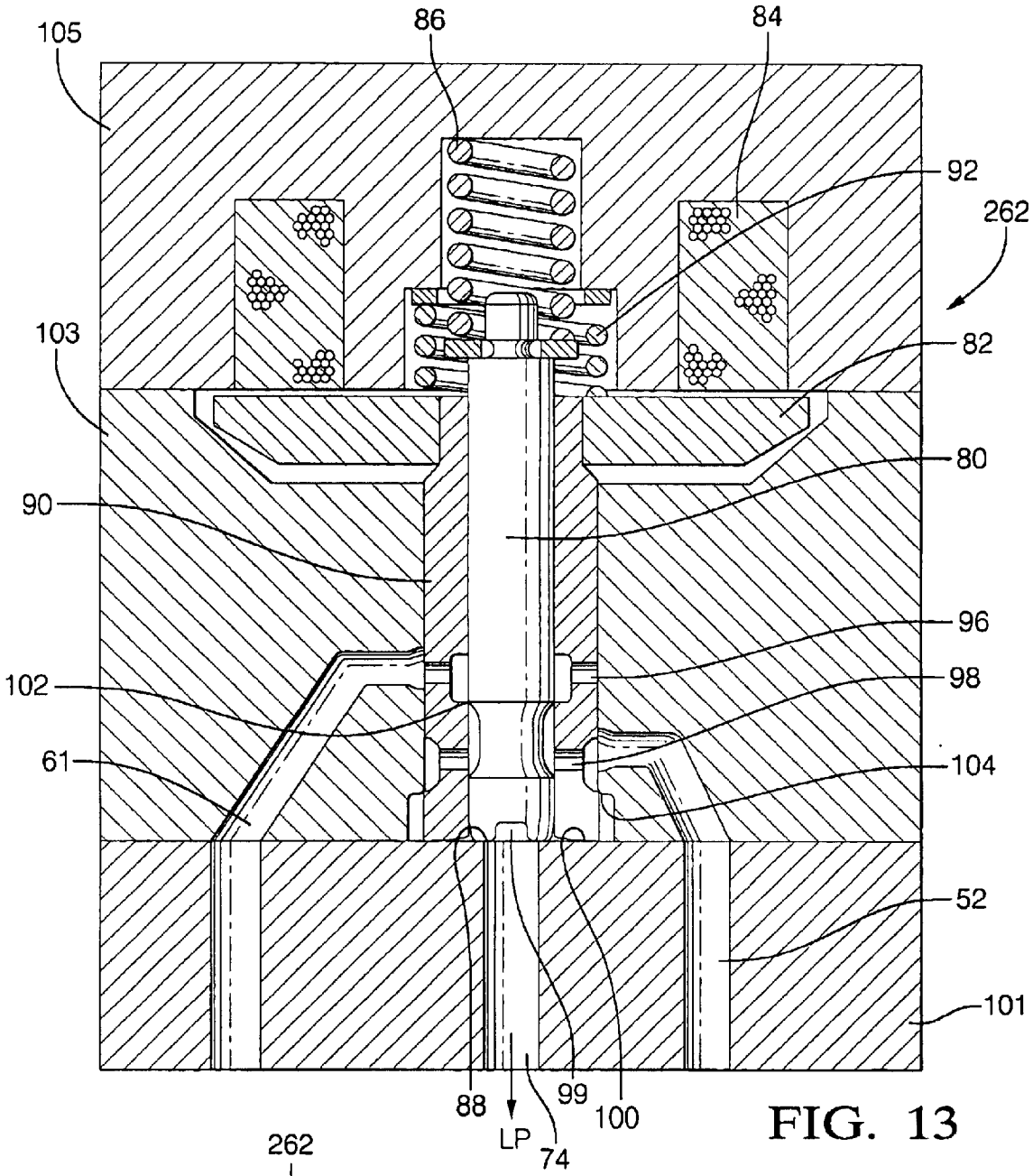
FIG. 13 is a sectional view of a three position valve for use in a further alternative embodiment of the fuel injection system.
Figure 14:
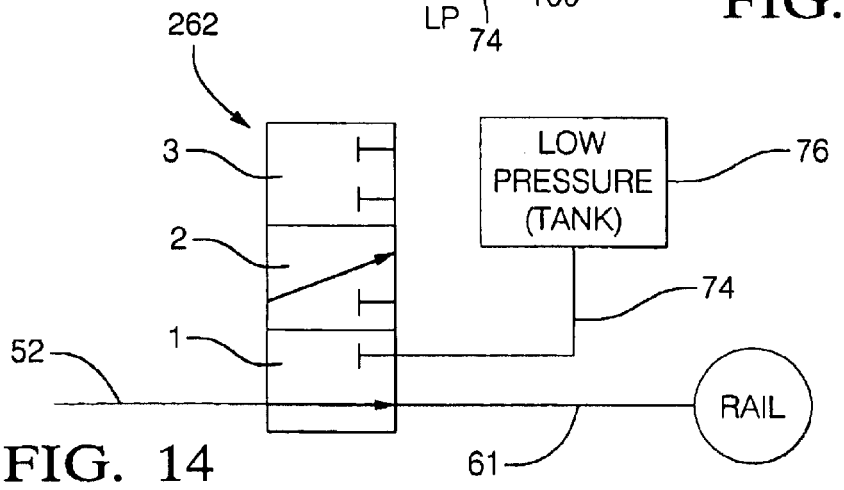
FIG. 14 is a schematic view of the valve in FIG. 3 to show its three operating positions.
Figure 15:
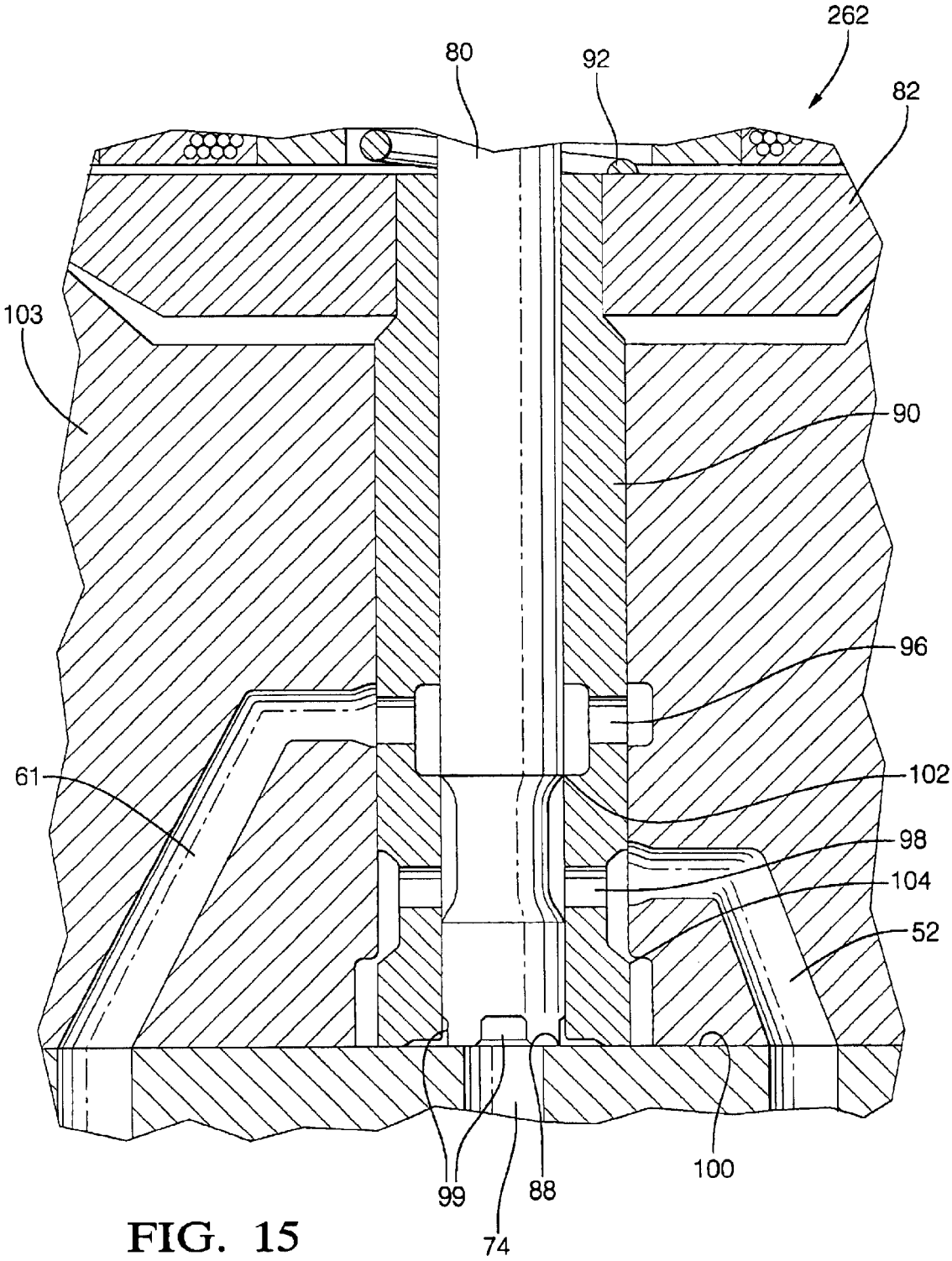
FIG. 15 is an enlarged sectional view of the three-position valve in FIGS. 13 and 14, with an insert showing seatings of the valve in enlarged detail.

In a further alternative embodiment of the fuel injection system in FIGS. 7 to 9 and 12, a valve having three different operating positions may be provided to control the level of fuel pressure that is supplied to the injector 14 through the supply line 52. Referring to FIGS. 13, 14 and 15, a three-position valve, referred to generally as 262, may be included in the fuel injection system. The three-position valve 262 may be included in the system of FIGS. 7 to 9, in place of the two-position rail control valve 62, or may be included in the system of FIG. 12 in place of the rail control valve 62 and the fill/spill valve 162.

The following description assumes the three-position valve 262 is included in the system of FIGS. 7 to 9, in place of the rail control valve 62, with like reference numbers being used to denote similar parts. The three-position valve 262 is operable between a first position 1 (as in FIG. 14) in which the rail pressure line 61 communicates with the high pressure supply line 52 to the injector 14 (common rail-type mode), a second position 2 in which the high pressure supply line 52 communicates with a low pressure reservoir 76 through a return line 74, and a third position 3 in which communication between the return line 74 the high pressure line 52 is broken and in which communication between the rail pressure line 61 and the high pressure supply line 52 is broken (EUI-type mode).

The three-position valve includes an inner valve member 80 and an outer valve member 90 that is coupled to an armature 82 of an electromagnetic actuator that also includes an electromagnetic winding 84. The three-position valve includes spring means in the form of an inner valve spring 86 that is arranged to urge the inner valve member 80 into a position in which it engages a stop surface 88. The inner valve member 80 extends through and is slideable within a through bore of the outer valve member 90, and is provided with a plurality of cut-away regions at its end adjacent to the stop surface 88 to define a flow path 99 for fuel into the return line 74. The outer valve member 90 is provided with first and second cross drillings 96, 98 respectively that define flow paths for fuel in dependence upon the position of the valve 262, as described further below.

The valve 262 is comprised of first, second and third housing parts 101, 103 and 105 respectively. A surface of the first housing part 101 defines the stop surface 88 for the inner valve member 80 and a first valve seating 100 for the outer valve member 90. The spring means of the three-position valve 262 also includes an outer valve return spring 92 associated with outer valve member 90 that serves to urge the outer valve member 90 into engagement with the first seating 100. A second valve seating 102 for the outer valve member 90 is defined by the inner valve member 80, and a third valve seating for the outer valve member is defined by a surface of a bore in the housing 103.

The outer valve member 90 is engageable with the first and third valve seatings 100, 104 to control fuel flow between the high pressure line 52 and the return line 74, and is engageable with the second valve seating 102 to control fuel flow between the high pressure fuel line 52 and the rail pressure line 61 and whether movement of the outer valve member 90 is coupled to the inner valve member 80 when the outer valve member 90 is caused to lift away from the first valve seating 100.

The outer valve member 90 is urged into engagement with the first valve seating 100 by means of the outer valve spring 92, and in which position the outer valve member 90 is spaced from the second valve seating 102. With the winding 84 de-energised the outer valve member 90 is engaged with the first seating 100, but spaced from the second seating 102, and the inner valve member 80 is engaged with the stop surface 88. This is the first operating position 1 of the valve 262 (as shown in FIG. 14) in which the rail pressure line 61 is in communication with the high pressure line 52 to the injector 14 by virtue of the cross drillings 96, 98 in the outer valve member 90.

If the nozzle control valve 54 is actuated when the valve 262 is in this first valve position, the pressure of fuel injected to the engine is therefore at the first, moderate rail pressure, P1, as described previously.

Upon partial energisation of the winding 84 to a first energisation level, the force applied to the armature 82 causes the outer valve member 90 to move against the force of the outer valve return spring 92, so that the outer valve member 90 moves away from the first valve seating 100 and an outer surface of the outer valve member 90 is brought into engagement with the second seating 102 defined by the inner valve member 80. The force due to the inner valve return spring 86 is large enough to ensure the inner valve member 80 remains seated against the stop surface 88. Communication between the rail pressure line 61 and the high pressure supply line 52 is therefore broken as fuel is no longer able to flow past the second seating surface 102.

As the outer valve member 90 has been moved away from the first valve seating 100, however, the high pressure line 52 is brought into communication with the return line 74 through the flow path 99 defined at the end of the inner valve member 80. This operating condition of the valve 262 is referred to as "the third valve position", as shown in FIG. 14.

It will be appreciated that the seatings 102, 104 are arranged and positioned such that in this third valve position the outer valve member 90 remains spaced from the third seating 104 to ensure fuel within the high pressure line 52 is able to flow to the return line 74.

When the winding is energised to a higher energisation level, there is sufficient force on the armature 82 to overcome the force due to the inner valve return spring 86. This causes further movement of the outer valve member 90 away from the first seating surface 100 and additionally causes movement of the outer valve member 90 to be coupled to the inner valve member 80 by virtue of engagement between the outer valve member and the second seating 102. The coupling of the outer valve member 90 to the inner valve member 80 causes the inner valve member 80 to be lifted away from the stop surface 88. The outer valve member 90 is brought into engagement with the third seating 104. This shall be referred to as the second valve position, in which position fuel is unable to flow past the third seating 104 so that communication between the high pressure supply line 52 and the return line 74 is broken. Communication between the rail pressure line 61 and the high pressure supply line 52 remains broken due to the valves 80, 90 being engaged at the second seating 102, and so it is in this position (position 2) that pumping by the plunger 66 results in the second, higher pressure level (P2) being achieved in the pump chamber 64.

It will be appreciated that the three-position valve 262 in FIGS. 13 to 15 provides a means of operating the fuel injection system in the same manner as described with reference to FIGS. 7 to 9. In addition, however, because communication between the high pressure supply line 52 and the return line 74 can be opened with the valve 262 in the third operating position, whilst maintaining pressure in the rail pressure line 61 (and hence the common rail 59) at the moderate, rail pressure, it is also possible to terminate injection using a spill-end type of injection. By moving the valve 262 into its third operating position, pressure of fuel in the high pressure supply line 52 is reduced and the valve needle 16 is caused to close under the force of the spring 53. Termination of injection can therefore be implemented without operating the nozzle control valve 54, if desired. It has been found that this may provide an improved fuel spray formation at the end of injection.

In addition to moving the three-position valve 262 into its third position to terminate injection, the nozzle control valve 54 may also be operated at the same time so as to achieve a more rapid end to injection, if desired.

The three-position valve show in FIGS. 13 to 15 is one example of a valve structure for achieving the three desired operating positions 1, 2 and 3, but other valve structures for achieving this are also envisaged. For example, in an alternative embodiment the inner valve 80 may be coupled to the armature 82, with the outer valve member 90 being coupled to move with the inner valve member 80 under partial energisation conditions. Our co-pending European patent application 03250956.4 describes other possible configurations for a three-position valve 262 of this type in further detail.

A further alternative embodiment to those shown described previously is shown in FIG. 16. Similar parts to those shown in FIG. 12 are identified with like reference numerals and will not be described in further detail. In this embodiment, the rail control valve 62 is provided, as before, to control whether the pump chamber 64 communicates with the common rail 59. In addition, a non return valve 362 is provided, having a non return spring 364, to control communication between the transfer pump 72 and the pump chamber 64. The non return valve 362 is hydraulically operable in dependence upon the fuel pressure difference across it. During the return stroke of the plunger 66 when fuel pressure in the pump chamber 64 is decreasing, the pressure of fuel supplied by the transfer pump 72 is sufficient to overcome the force of the non return spring 364 so that the non-return valve 362 is opened and fuel is supplied from the transfer pump 72 to the pump chamber 64. As the pumping plunger 66 is driven to perform its pumping stroke, the pressure of fuel in the pump chamber 64 will be increased and the non-return valve 362 is caused to close and continued pumping causes the pressure of fuel within the pump chamber 64 to increase further.

As described previously, if the rail control valve 62 is in its open state the pressure of fuel within the pump chamber 64 is pressurised to a first, moderate rail pressure, but if the rail control valve 62 is closed fuel pressure within the pumping chamber 64 will be increased to the second, higher level.

In order to inject fuel at the first, moderate rail pressure level, P1, the rail control valve 62 is opened so that the pump chamber 64 communicates with the common rail 59. In order to inject fuel at the second, higher pressure level, P2, the rail control valve 62 is closed, so that communication between the pump chamber 64 and the common rail 59 is broken.

The combination of the rail control valve 62 and the non return valve 362 in the embodiment of FIG. 16 therefore provides a similar function to the rail control valve 62 and the fill/spill 162 in FIG. 12, and to the three-position valve described with reference to FIGS. 13 to 15. However, the fill/spill valve 162 in the FIG. 12 embodiment and the three-position valve 262 in the embodiment of FIGS. 13 to 15 provide an additional degree of control in that their use permits rail pressure to be spilled back to the transfer pump 72. Simply incorporating the non return valve 362 and the rail control valve 62 in place of the rail control valve 62 and the fill/spill valve 162 in FIG. 12, or in place of the three-position valve of FIGS. 13 to 15, does not, however, provide an option to spill-end injection. As mentioned previously, it has been recognised that terminating injection using a spill end technique can be advantageous, as terminating injection by forcing the valve needle 16 to close against a high force due to pressurised fuel within the injection nozzle can result in an undesirable fuel spray formation. For this reason, in systems for which the combination of the rail control valve 62 and the non-return valve 362 is preferred (as in FIG. 16), it is desirable to include an additional high pressure shut off valve arrangement in the system.

Figure 16:
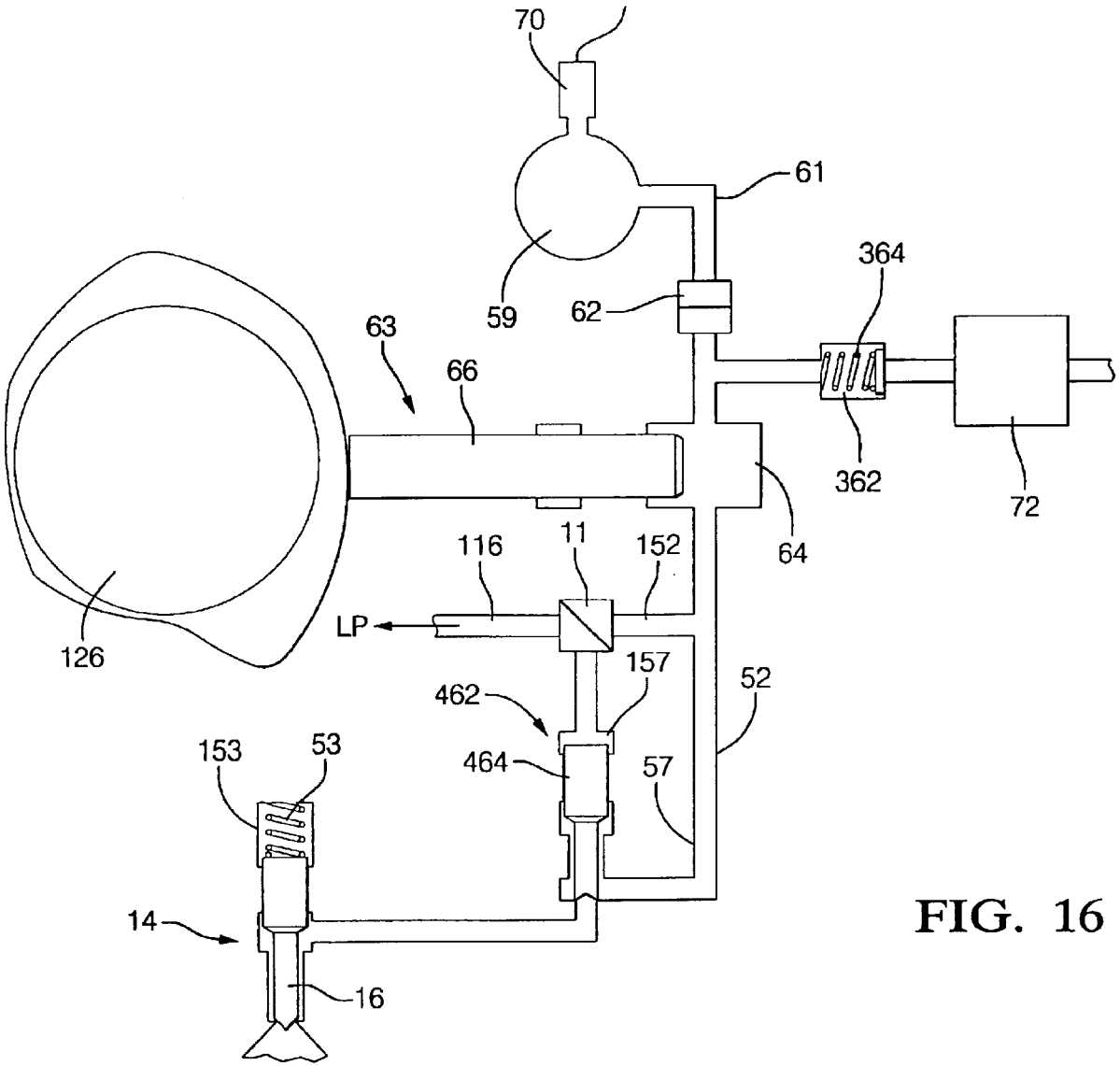
FIG. 16 is a further alternative embodiment of the fuel injection system incorporating a high pressure shut off valve.

In the embodiment shown in FIG. 16, the fuel injection system is therefore provided with control valve means in the form of a control valve 11 and a shut off valve arrangement 462 arranged within the high pressure fuel line 52. The control valve 11 is arranged to control fuel pressure within a control chamber 157 associated with the shut off valve 462, and thereby controls movement of the injector valve needle as described in further detail below. This configuration for controlling valve needle movement differs from the embodiments described previously, in that instead of providing a nozzle control valve 54 to control fuel pressure within an injector control chamber 57 at the back end of the valve needle, the control valve 11 acts to control fuel flow through the high pressure line 52 to the nozzle. In the embodiment of FIG. 16, the chamber 153 at the back end of the valve needle simply forms a chamber for housing the valve needle spring 53, and whether or not the valve needle is lifted from its seating to inject fuel is determined by opening and closing the shut off valve 462.

Figure 17:
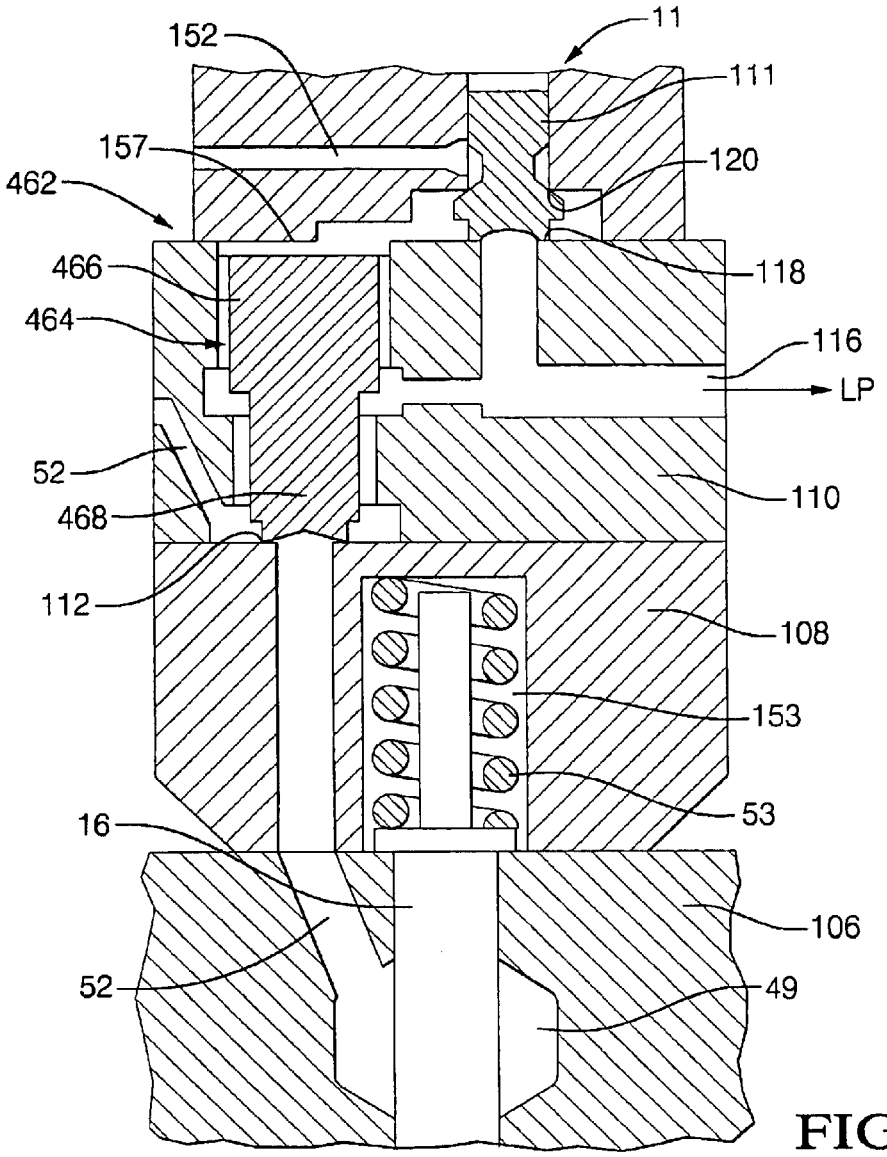
FIG. 17 is a schematic view of the high pressure shut off valve arrangement in the embodiment of FIG. 18.

One practical embodiment of the high pressure shut off valve 462, and its configuration in relation to the control valve 11 and the injector valve needle 16, is shown in further detail in FIG. 17. The shut off valve 462 includes a shut off valve member 464 that is arranged within the high pressure supply line 52 to the delivery chamber 49 of the injector. The chamber 153 at the back end of the valve needle 16 houses a spring 53 which serves to urge the valve needle 16 into a closed position. It can be seen in FIG. 17 that the valve needle 16, the chamber 153 and the shut off valve member 464 are housed in adjacently mounted housing parts 106, 108, 110.

The shut off valve member 464 is movable within a stepped bore 121 formed in the housing part 110 under the control of the control valve 11. In the operating condition shown in FIGS. 16 and 17, the shut off valve member 464 is in a first position (a "closed" operating position) in which the shut off valve member 464 is engaged with a shut off valve seating 112 defined by a surface of the housing part 108 so that the flow of fuel through the high pressure supply line 52 to the injector delivery chamber 49 is prevented. The shut off valve member 464 is movable away from the shut off valve seating 112 into a second position (an "open" operating position) in which the flow of fuel through the high pressure supply line 52 to the injector delivery chamber 49 is permitted.

The control valve 11 has a control valve member 111 which is movable between a first position (herein referred to as a closed position), in which a branch passage 152 from the high pressure supply line 52 communicates with a control chamber 157 at a back end of the shut off valve member 464 and communication between the control chamber 157 and a low pressure reservoir is closed, and a second position (herein referred to as an "open" position) in which the chamber 157 communicates with the low pressure reservoir through a drain passage 116 and communication between the branch passage 152 and the chamber 157 is broken. It cannot be fully appreciated from the scale of the drawing in FIG. 17, but the control valve member 111 is engaged with a first seating 118 when in its closed position to break communication between the chamber 157 and the drain passage 116 and is engaged with a second seating 120 when in its open position to open communication between the control chamber 157 and the drain passage 116 and to break communication between the branch passage 152 and the control chamber 157.

The shut off valve member 464 is movable between its open and closed positions in response to the hydraulic forces acting on surfaces of upper and lower end regions 466, 468 respectively of the valve member 464. The shut off valve member 464 is shaped to include upper and lower regions of different diameter. The upper end 466 has a first effective surface area exposed to fuel pressure within the control chamber 157. The lower end region 468 defines a surface area of annular form that is exposed to fuel pressure within the high pressure line 52 when the shut off valve member 464 is in its closed position, and when the shut off valve member is in its open position a second effective surface area is exposed to fuel pressure in the high pressure line 52. The first effective surface area of the upper end region 466 is greater than this second effective surface area of the lower end region 468. A gallery 122 defined in the region of the step in the bore 121 communicates continuously with the drain passage 116 to low pressure so as to prevent the occurrence of a hydraulic lock.

In use, the function of the shut off valve 462 is essentially the same in both the common-rail type and the EUI-type modes of operation (i.e. at both the first and second injectable pressure levels). If the control valve member 111 is moved to its open position in which it is seated against the second seating 120, the control chamber 157 communicates with the low pressure reservoir and hence the shut off valve member 464 will be urged away from the shut off valve seating 112 into its open position due to high fuel pressure within the supply line 52 (whether at pressure P1 or P2) acting on the exposed annular surface area of its lower end 468. Additionally, as the shut of valve member 464 starts to open, the lowermost end surface will also experience building pressure in the downstream portion of the high pressure line 52 and so eventually the entire end surface of the shut off valve member 464 (i.e. the second effective surface area) is exposed to high fuel pressure in the line 52. When the control valve member 111 is moved into this open state, fuel at either the first or second injectable pressure level is therefore able to flow through the open shut off valve 262, into the supply line 52 to the injector delivery chamber 49. As the pressure of fuel delivered to the delivery chamber 49, and hence to the downstream parts of the injector, a force is applied to the valve needle 16 that is sufficient to overcome the closing force of the spring 53 and, hence, fuel is injected to the engine.

If the control valve member 111 is moved into its closed position in which the control valve member 111 is moved away from the second seating 120 and is caused to seat against the first seating 118, high pressure fuel within the high pressure supply line 52 is able to flow through the branch passage 152 and into the control chamber 157 at the upper end 466 of the shut off valve member 464. As the first effective surface area of the shut off valve member 464 at its upper end 466 is greater than the second effective surface area of the shut off valve member 464 at its lower end 468 (i.e. the surface area experiencing fuel pressure within the high pressure line 52), this will cause the shut off valve member 464 to be urged against the shut off valve seating 112 into its closed position in a "plug type" fashion. As a result, the flow of fuel through the high pressure supply line 52 to the injector delivery chamber 49 is cut off, and the valve needle 16 is therefore urged closed by means of the force of the spring 53 overcoming reduced fuel pressure within the injector 14.

When the control valve 11 is actuated to terminate injection, the pressure of fuel delivered to the injector 14 will decay naturally, but rapidly, as injection continues to the associated engine cylinder. A point will be reached at which the force due to the valve needle spring 53 (in combination with the force due to any fuel pressure within the chamber 153) is sufficient to move the valve needle 16 to its seat and, hence, injection is terminated. Termination of injection in this manner has a similar characteristic to that of a spill-type end of injection, in that the valve needle 16 is urged to close against reducing or reduced fuel pressure within the injector 14.

In practice, the force of the valve needle spring 53 is preferably selected to be as low as practicable to ensure that substantially no high pressure fuel flows through the supply line 52 to the injector 14 when the valve needle 16 is at partial lift. In this way there is substantially no injection of fuel when the valve needle 16 is at partial lift. Typically, the spring 53 is selected so that the pressure of fuel in the high pressure supply line 52, whether initially at moderate rail pressure or at the second, higher pressure level, decays to around 200 bar before the valve needle 16 starts to close. In other words when fuel pressure decays to less than 200 bar the force due to the spring 53 is sufficient to seat the needle 16 against this fuel pressure. During closure, with the valve needle 16 in a partially lifted position (i.e. partial closure), there is a considerably reduced injection rate through the injection nozzle outlets and the pressure of fuel available for injection is therefore much reduced as the valve needle closes.

It will be appreciated, however, that there is a limit on how low the spring force can be, as there is also a requirement for the spring to be sufficient to ensure that cylinder gas pressure during combustion cannot unseat the valve needle 16.

It is a particular benefit of the shut off valve in FIG. 17 that the seat 112 for the shut off valve 462 and the stepped diameter of the shut off valve member 464 provide a particularly convenient valve construction for manufacturing purposes.

In an alternative embodiment (not shown) of the shut off valve 462 in FIG. 17, the shut off valve member 464 may be substantially pressure-balanced to pressure upstream of the valve 462, so that the first effective surface area of the upper end 466 of the valve 464 exposed to fuel pressure within the control chamber 157 is substantially identical to the second effective surface area of the lower end region 468 of the valve member 464 that is exposed to fuel pressure within the high pressure line 52. In this embodiment, a suitable closing spring may be provided to provide the force imbalance required to cause the shut off valve 464 to close when the control valve 11 is moved into its closed position (in which the high pressure line 52 communicates with the chamber 157).

In a still further alternative embodiment (not shown), the shut off valve 462 may be shaped, by appropriate choice of its first and second effective surface areas, so that fuel that is supplied to the control chamber 157 is at a lower pressure than fuel supplied through the high pressure fuel line 52.

It will be appreciated that although the valve needle 16, the injector chamber 153 and the shut off valve member 464 are housed in adjacent housing parts 106, 108, 110 in the FIG. 17 embodiment, in practice these components 16, 153, 464 may be arranged in parts that are spaced from one another or may alternatively be arranged within a housing part that is common to one or more of the other components.

Figure 18:
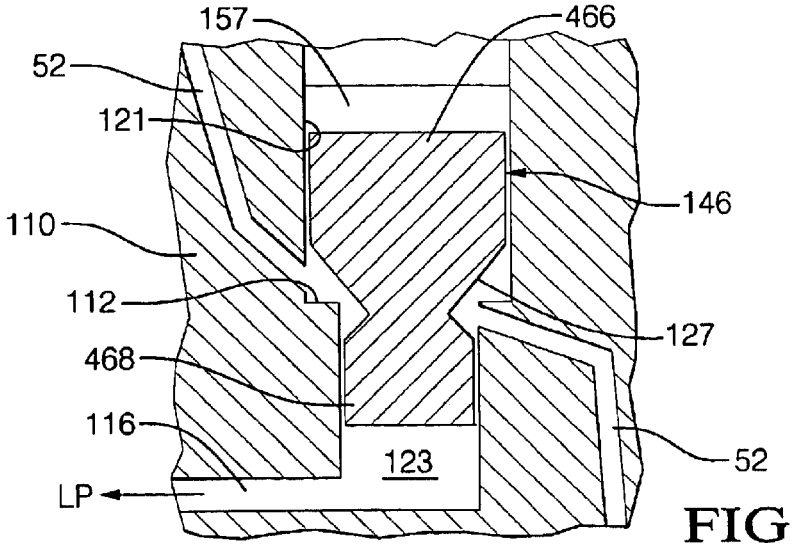
FIG. 18 is a schematic view of an alternative shut off valve member for us in the shut off valve arrangement in FIG. 17.

FIG. 18 shows an alternative construction of the shut off valve (again not pressure balanced). In FIG. 18, the shut off valve member 1464 includes an upper end 466, having a first diameter, that defines a surface exposed to fuel pressure within the control chamber 157, as in the FIG. 17 embodiment. The lower end 468 of the valve member 1464, however, having a second diameter, is exposed to fuel pressure within a chamber 123 in communication with a drain passage 116. The first diameter of the upper end 466 of the valve member 1464 is greater than the second diameter of the lower end of the valve member 1464. The valve member 1464 is guided within the bore 121 at its first and second diameter regions 466, 468. A seating surface 127 of substantially part-conical form is defined by an intermediate region of the shut off valve member 1464 between the first and second end regions 466, 468, and is engageable with a substantially flat shut off valve seating 1112. The seating surface 127 and the seating 1112 are shaped so that they engage over an annular region having a diameter substantially equal to the second diameter (or "guide" diameter) of the lower region 468 of the valve member 1464.

In this embodiment the first effective surface area of the valve member 1464 is defined by the upper end 466 of the valve member 1464, and the second effective surface area is defined by the differential area of the seating surface 127 (i.e. that area over which fuel within the high pressure line 52 acts when the valve member 1464 is seated, as determined by the difference in diameter between the upper and lower ends 466, 468).

As in the FIG. 17 embodiment, if the control valve 11 is operated so as to move the shut off valve member 1464 into engagement with the seating 1112, fuel within the high pressure supply line 52 is unable to flow to the delivery chamber 49 of the injector 14. If the control valve 11 is operated so as to move the shut off valve member 1464 away from the seating 1112 (i.e. de-pressurising the chamber 157), fuel within the high pressure supply line 52 is able to flow to the delivery chamber 49.

It is an advantage of the embodiment of the shut off valve in FIG. 18, that any out of balance forces acting on the valve member 1464 are substantially the same at all times i.e. with the valve 1464 in its open and closed positions. When the shut off valve member 1464 is in its seated position, an outer part of the conical surface 127 will be exposed to fuel flowing through the high pressure supply line 52 into the bore 121. As the shut off valve member 1464 starts to move away from the seating 1112 an annular chamber 125 is opened up to receive high pressure fuel from the supply line 52, and thus fuel flows through this chamber 125 to the downstream portion of the high pressure supply line 52. However, there is no change in the net hydraulic force acting on the valve member 1464 during opening. The flow of fuel being controlled by opening and closing the valve 462 (i.e. the flow through the high pressure supply line 52) therefore has substantially no hydraulic influence on the valve member 1464 as it opens.

In comparison with this, as the shut off valve member 1464 of the FIG. 17 embodiment starts to open, high pressure fuel within the supply line 52 will act on the entire end surface of the lower end 468 of the valve member 464. It has been found that the shut off valve design incorporating the conical seating 127 and, hence, the annular chamber 125 for receiving high pressure fuel from the supply line 52, improves the balancing of forces on the shut off valve member 1464.

It is a further feature of the shut off valve of the FIG. 18 embodiment that the differential area of the surface 127 (i.e. that area exposed to high pressure within the line 52 when the valve member 1464 is seated) is small compared with the much larger effective area of the upper region 466 that experiences high fuel pressure as the chamber 157 is re-pressurised when the control valve 11 is closed. The combination of a relatively small "opening" area and a relatively large "closing area" is particularly advantageous for enabling a pilot injection of fuel in which only a small quantity of fuel is delivered.

It will be appreciated that the advantageous features of the shut off valve 1462 in FIG. 18 may be achieved if a valve seating of frusto-conical form is used, as opposed to a substantially flat seating such as 1112, by providing a shut off valve member 1464 having an appropriate differential area.

It is a further advantage of the shut off valve arrangement 462, either as shown in FIG. 17 or FIG. 18, that it is possible to achieve a "pulsed" injection of fuel to the engine, whilst the valve needle 50 is in a lifted position. This may be achieved by controlling the control valve 11 so as to cause the shut off valve 462 to move rapidly between its open and closed positions, such that the supply of high pressure fuel through the supply line 52 is halted or varied. When the supply of fuel to the injector 14 is halted, injection is interrupted or significantly reduced.

For example, if the control valve 11 is actuated to open the shut off valve 464, 1464 fuel is supplied to the injector 14 and the valve needle 16 lifts from its seating to commence injection. The control valve 11 is then switched rapidly to close the shut off valve 462, halting the flow of fuel to the injector, and is then switched rapidly to open the shut off valve 464, 1464 to allow fuel flow to the injector 14 once again. The response of the valve needle 16 is slower than that of the shut off valve 462, and so throughout these actuation steps of the control valve 11 the valve needle 16 does not re-seat against the valve needle seating. The injection of fuel is therefore interrupted.

This method is particularly useful for achieving a pilot injection of fuel followed by a main injection of fuel, for example as shown in FIG. 10, and the "pulsing" of injection in this way may be achieved more rapidly by actuation of the control valve 11 to open and close the shut off valve 462 than can be achieved by opening and closing the valve needle 16 by means of a nozzle control valve (such as item 54 in FIG. 12). It is by virtue of the slow response of the valve needle 16 that injection pulsing can be achieved. The added benefit of using the shut off valve 462 to "pulse" injection is that, as referred to previously, there is no requirement to shut or seat the valve needle against high fuel pressure in the nozzle, so that fuel spray degradation problems are avoided.

If it is required that the pilot injection of fuel is at a lower injectable pressure (e.g. the first, moderate injectable pressure), than the main injection of fuel, the rail control valve 62 may be operated independently during the period between opening and closure of the shut off valve 462 to interrupt injection so as to increase the pressure that is delivered through the high pressure supply line 52. This may be done at or about the same time as the shut off valve 462 is opened again to re-start injection (i.e. the next injection pulse), or may be done at any time depending on the particular injection characteristic that is required.

It will be appreciated that any of the valves 62, 162, 262 described previously may preferably, but need not, be electrically or electromagnetically operated by energisation or de-energisation of an electromagnetic actuator winding. It will further be appreciated that references to "actuation of a valve" to cause a valve to move between its operating positions may, for an electromagnetically operable valve, be implemented either by increasing the energisation level of the actuator winding or by decreasing the energisation of the winding to cause said movement. Other forms of valve actuation means would, however, be envisaged by those skilled in the art, both hydraulic and/or mechanical, whilst still achieving the required valve functions.

For any of the embodiments of the invention described previously, typically the system may be operated so as to achieve injection at a first pressure level that is significantly lower than the second pressure level, for example so as to permit a pilot injection of fuel at pressure P1 to be followed by a main injection of fuel at pressure P2 (for example, as shown in FIG. 10), or to permit a boot-shaped injection event to be achieved (for example, as shown in FIG. 11). For example, the second pressure level that is achieved with the rail control valve 62 closed may be between 5 and 10 times higher than the first pressure level that is achieved when the rail control valve 62 is open.

One practical embodiment of the fuel system of the present invention, as for any of the embodiments described previously, is shown in FIG. 19. For clarity, corresponding features to those shown in FIGS. 7 to 9 are denoted with the same reference numerals. The cam drive arrangement includes a cam follower 124 that rides over the surface of the cam 26 as the cam rotates and is arranged to impart drive to a drive member 126, for example in the form of a tappet, that is coupled to the plunger 66. The drive member 126 is driven under the influence of the cam arrangement 68, 124 to reciprocate within a cylinder 128 and, thus, imparts reciprocating movement to the plunger 66. A pin 130 is secured to the drive member 126, and a return spring 132 is mounted upon a shaft 134 of the engine which cooperates with the pin 130 so as to return the drive member 126 and follower mechanism as the follower 124 rides over a falling flank of the cam 68. The plunger 66 is arranged to be substantially perpendicular to the axis of the injector.

Figure 19:
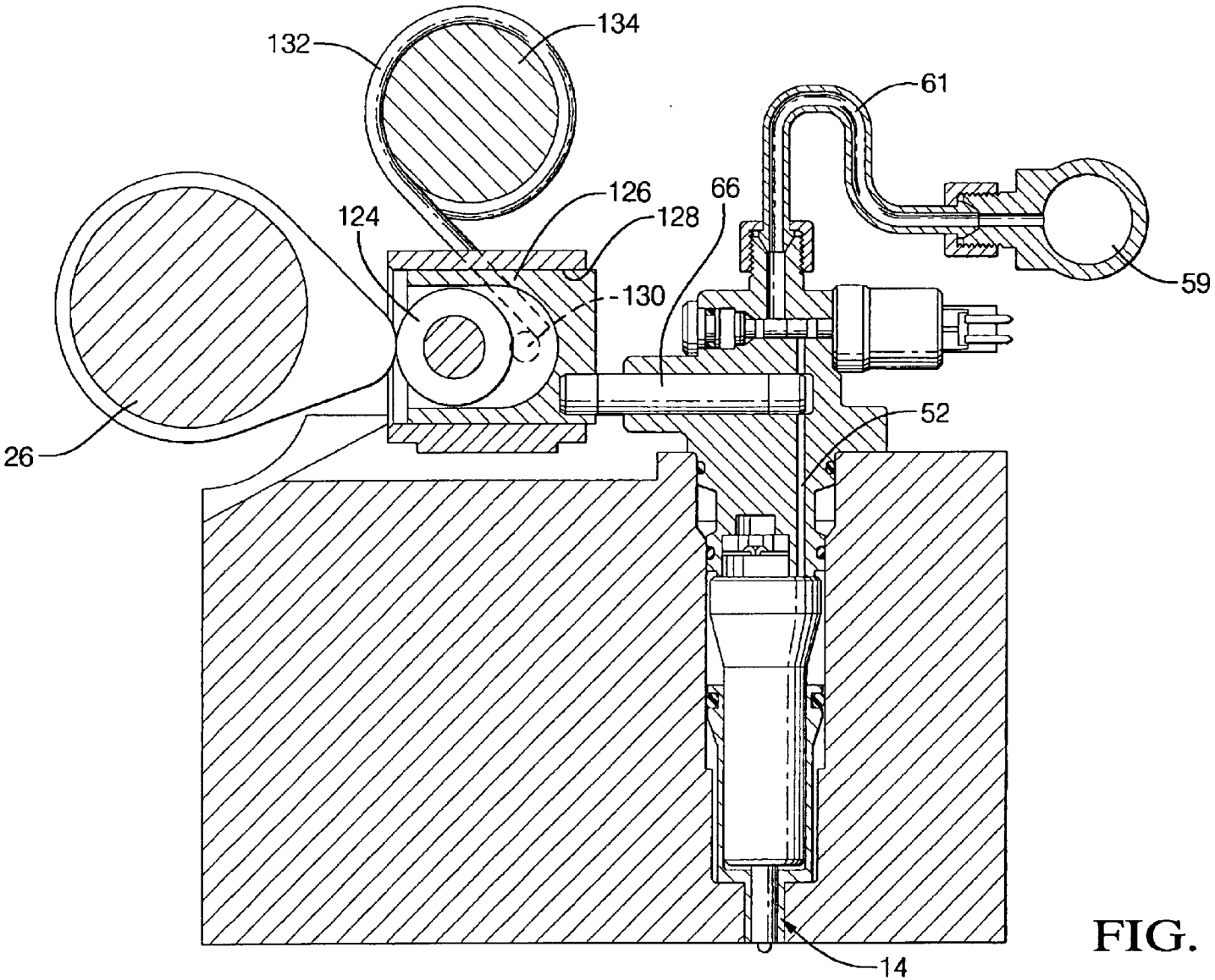
FIG. 19 shows a sectional view of one practical embodiment of the fuel injection system described with reference to FIGS. 7 to 17.

As can be seen in FIG. 19, the diameter of the common rail 59 is smaller than that of the shaft 134. It is possible to use a common rail 59 of relatively small size, as it need only be charged with fuel at the first, moderate pressure level due to the provision of the pump arrangement 63 and the rail control valve 62 which permit an increased pressure level to be supplied to the injector 14 when the rail control valve 62 is closed. By way of example, the moderate pressure of fuel within the rail may be around 300 bar, compared with pressures around 2000 bar in known common rail systems. As the common rail 59 may be of relatively small size, it is possible to house the rail 59 within another component of the engine.

In an alternative configuration to that shown in FIG. 19, the shaft 134 may be the engine rocker shaft and may be hollow so that the rail may extend through a region of the hollow shaft. As a further alternative the rail may be provided within a region of an engine cylinder head.

It will be appreciated that the fuel injection system of any of the embodiments described previously may be implemented as in FIG. 19.

Obviously, many modifications and variations of the present invention are possible in light of the above teachings. The invention may be practiced otherwise than as specifically described within the scope of the appended claims.

What is claimed is:

1. A fuel system for use in an internal combustion engine, the fuel system comprising;

a fuel pump having a pumping cycle during which fuel is pressurised to a high level within a pumping chamber for delivery to an injector, whereby the injector is arranged to provide a primary fuel injection event, and a secondary fuel injection event within the same pumping cycle, in use;

the injector including a valve needle which is engageable with a valve needle seating to control fuel delivery and an injection control valve arrangement for controlling movement of the valve needle so as to control the primary and secondary fuel injection events; and, the fuel system further comprising an accumulator volume for storing high pressure fuel for delivering the secondary fuel injection quantity, and an additional valve arrangement for controlling the supply of fuel stored within the accumulator volume to the injector for the secondary injection event.

2. A fuel system as claimed in claim 1, whereby the primary injection event takes the form of a main fuel injection event, during which a main fuel injection quantity is delivered, and the secondary injection event takes the form of a late post injection event, during which a late post fuel injection quantity is delivered, whereby the late post injection of fuel occurs after the main injection of fuel in the pumping cycle.

3. A fuel system as claimed in claim 2, including an after treatment device.

4. A fuel system as claimed in claim 2, wherein the additional valve arrangement is arranged to deliver a late post fuel injection quantity which is approximately the same as the main fuel injection quantity.

5. A fuel system as claimed in claim 2, wherein the additional valve arrangement is arranged to deliver a late post fuel injection quantity of approximately between 5% and 20% of the main fuel injection quantity.

6. A fuel system as claimed in claim 2, wherein the injection control valve arrangement and the additional valve arrangement are arranged to provide a sequence of between 3 and 5 consecutive main fuel injection events, each of which is accompanied by a late post fuel injection event.

7. A fuel system as claimed in claim 2, wherein the injection control valve arrangement and the additional valve arrangement are arranged to provide a periodic distribution of late post fuel injection events between main fuel injection events.

8. A fuel system as claimed in claim 2, wherein the additional valve arrangement takes the form of an electromagnetically operable valve.

9. A fuel system as claimed in claim 2, wherein the additional valve arrangement takes the form of an hydraulically operable valve.

10. A fuel system as claimed in claim 9, wherein the hydraulically operable valve includes a valve member which is movable between open and closed states in response to a fuel pressure difference across the valve member, whereby when the valve member is in the open state fuel from the accumulator volume is able to flow from the accumulator, through a return passage, into the high pressure fuel line for the purpose of administering the late post injection of fuel.

11. A fuel system as claimed in claim 10, wherein the valve member is biased towards a closed state by means of a valve spring housed within a spring chamber.

12. A fuel system as claimed in claim 11, wherein the spring chamber communicates with low pressure.

13. A fuel system as claimed in claim 11, wherein the spring chamber communicates with the accumulator volume.

14. A fuel system as claimed in claim 11, wherein the spring chamber communicates with the high pressure line.

15. A fuel system as claimed in claim 9, wherein the additional valve arrangement further includes at least a first non-return valve, arranged in a primary supply passage, for controlling the flow of high pressure fuel from the high pressure supply line to the accumulator volume.

16. A fuel system as claimed in claim 1, wherein the injection control valve arrangement and the additional valve arrangement are arranged to provide the primary injection event at a primary fuel injection rate, and the secondary injection event at a secondary fuel injection rate which is greater than the primary fuel injection rate.

17. A method of delivering fuel to an internal combustion engine provided with an after treatment device for reducing emission levels, the method comprising;

driving a pumping plunger to perform a pumping stroke of a pumping cycle, thereby to pressurise fuel within the pumping chamber to a high level, following which the pumping plunger performs a return stroke of the pumping cycle;

delivering high pressure fuel to an injector associated with the engine through a high pressure line;

controlling an injection control valve arrangement to move between an open state to commence a main fuel injection event and a closed state to terminate the main fuel injection event, during which main fuel injection event a main fuel injection quantity is delivered to the engine; and moving the injection control valve arrangement from the closed state to the open state to permit a late post fuel injection quantity to be delivered to the engine, within the pumping cycle and a period of time after the main fuel injection event, for the purpose of regeneration of the after treatment device;

whereby the late post injection quantity is delivered after completion of the pumping stroke.

18. A method as claimed in claim 17, whereby the late post injection quantity is delivered during a top dwell period between the pumping stroke and the return stroke of the plunger.

19. A method of delivering fuel to an internal combustion engine provided with an after treatment device for reducing emission levels, the method comprising:

driving a pumping plunger to perform a pumping stroke of a pumping cycle, thereby to pressurise fuel within the pumping chamber to a high level, following which the pumping plunger performs a return stroke of the pumping cycle;

delivering high pressure fuel to an injector associated with the engine through a high pressure line;

controlling an injection control valve arrangement to move between an open state to commence a main fuel injection event and a closed state to terminate the main fuel injection event, during which main fuel injection event a main fuel injection quantity is delivered to the engine;

moving the injection control valve arrangement from the closed state to the open state to permit a late post fuel injection quantity to be delivered to the engine, within the pumping cycle and a period of time after the main fuel injection event, for the purpose of regeneration of the after treatment device; and providing a sequence of around 3 to 5 consecutive main fuel injection events, each of which is accompanied by a late post fuel injection event.

20. A method as claimed in claim 19, whereby said sequence is provided once for each tank of fuel used by the engine.

21. A method of delivering fuel to an internal combustion engine provided with an after treatment device for reducing emission levels, the method comprising:

driving a pumping plunger to perform a pumping stroke of a pumping cycle, thereby to pressurise fuel within the pumping chamber to a high level, following which the pumping plunger performs a return stroke of the pumping cycle;

delivering high pressure fuel to an injector associated with the engine through a high pressure line;

controlling an injection control valve arrangement to move between an open state to commence a main fuel injection event and a closed state to terminate the main fuel injection event, during which main fuel injection event a main fuel injection quantity is delivered to the engine;

moving the injection control valve arrangement from the closed state to the open state to permit a late post fuel injection quantity to be delivered to the engine, within the pumping cycle and a period of time after the main fuel injection event, for the purpose of regeneration of the after treatment device; and providing a periodic distribution of late post injection events between main fuel injection events.

22. A fuel system for use in an internal combustion engine, the fuel system comprising;

a fuel pump having a pumping cycle during which fuel is pressurised to a high level within a pumping chamber for delivery to an injector, whereby the injector is arranged to provide a main fuel injection event and a post fuel injection event, during within the same pumping cycle;

the injector including a valve needle which is engageable with a valve needle seating to control said fuel delivery and an injection control valve arrangement for controlling movement of the valve needle so as to control the main and post fuel injection events; and, the fuel system further comprising an accumulator volume for storing high pressure fuel for delivering the post fuel injection quantity, and an additional valve arrangement actuable to control the supply of fuel stored within the accumulator volume to the injector for the post injection event, wherein the additional valve arrangement and the injection control valve arrangement share a common actuator.

23. A fuel system for use in an internal combustion engine, the fuel system comprising;

a fuel pump having a pumping cycle during which fuel is pressurised to a high level within a pumping chamber for delivery to an injector, whereby the injector is arranged to provide a main fuel injection event and a post fuel injection event, during within the same pumping cycle;

the injector including a valve needle which is engageable with a valve needle seating to control said fuel delivery and an injection control valve arrangement for controlling movement of the valve needle so as to control the main and post fuel injection events;

the fuel system further comprising an accumulator volume for storing high pressure fuel for delivering the post fuel injection quantity, and an hydraulically operable valve arrangement for controlling the supply of fuel stored within the accumulator volume to the injector for the post injection event.

* * * * *